US011448213B2

(12) United States Patent
Park et al.

(10) Patent No.: US 11,448,213 B2
(45) Date of Patent: Sep. 20, 2022

(54) SCROLL COMPRESSOR

(71) Applicant: Samsung Electronics Co., Ltd., Suwon-si (KR)

(72) Inventors: Junghoon Park, Suwon-si (KR); Sunghea Cho, Suwon-si (KR); Jongcheun Seo, Suwon-si (KR); Namkyu Cho, Suwon-si (KR); Dohyun Kim, Suwon-si (KR); Junguk Jun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 114 days.

(21) Appl. No.: 16/861,673

(22) Filed: Apr. 29, 2020

(65) Prior Publication Data

US 2020/0340476 A1 Oct. 29, 2020

(30) Foreign Application Priority Data

Apr. 29, 2019 (KR) ..... 10-2019-0049996
Feb. 11, 2020 (KR) ..... 10-2020-0016651

(51) Int. Cl.
*F04C 18/02* (2006.01)
*F04C 29/12* (2006.01)
(Continued)

(52) U.S. Cl.
CPC ..... *F04C 18/0215* (2013.01); *F04C 18/0261* (2013.01); *F04C 27/00* (2013.01);
(Continued)

(58) Field of Classification Search
CPC ..... F04C 18/0215; F04C 18/0246; F04C 18/0253; F04C 18/0261; F04C 28/16;
(Continued)

(56) References Cited

U.S. PATENT DOCUMENTS 5,551,852 A 9/1996 Saito et al.
7,338,265 B2 3/2008 Grassbaugh et al.
(Continued)

FOREIGN PATENT DOCUMENTS

CN 107923397 A 4/2018
EP 2781754 9/2014
(Continued)

OTHER PUBLICATIONS

Extended European Search Report dated Sep. 29, 2020 in European Patent Application No. 20171905.1.
(Continued)

*Primary Examiner* — Mark A Laurenzi
*Assistant Examiner* — Xiaoting Hu
(74) *Attorney, Agent, or Firm* — Staas & Halsey LLP

(57) ABSTRACT

A scroll compressor includes a main body, a cover to divide the main body into a low pressure section and a high pressure section, a fixed scroll including a first discharge port, an orbiting scroll to rotate with respect to the fixed scroll and to form a compression chamber together with the fixed scroll, a discharge guide disposed between the fixed scroll and the cover and including a second discharge port connected to the first discharge port, and a back pressure actuator configured to form a back pressure chamber together with the discharge guide and to move in a direction toward the cover with respect to the discharge guide to selectively connect the second discharge port with the high pressure section. The fixed scroll includes a bypass flow path connecting the compression chamber and the second discharge port and a bypass valve to open or close the bypass flow path.

10 Claims, 43 Drawing Sheets

(51) Int. Cl.
*F04C 28/26* (2006.01)
*F04C 27/00* (2006.01)

(52) U.S. Cl.
CPC ..... *F04C 28/26* (2013.01); *F04C 29/12* (2013.01); *F04C 29/124* (2013.01); *F04C 29/126* (2013.01)

(58) Field of Classification Search
CPC ..... F04C 28/24; F04C 28/26; F04C 29/12; F04C 29/124; F04C 29/126; F04C 29/128; F04C 27/00; F04C 27/001; F04C 27/002; F04C 27/003; F04C 27/005; F04C 27/008
See application file for complete search history.

(56) References Cited

U.S. PATENT DOCUMENTS

| | | | | |
|---|---|---|---|---|
| 8,651,842 | B2 | 2/2014 | Yamamoto et al. | |
| 8,932,036 | B2 * | 1/2015 | Monnier | F04C 27/008 418/55.4 |
| 9,249,802 | B2 | 2/2016 | Doepker et al. | |
| 9,297,383 | B2 | 3/2016 | Jin et al. | |
| 9,784,271 | B2 | 10/2017 | Jin et al. | |
| 10,451,064 | B2 | 10/2019 | Park et al. | |
| 2006/0198748 | A1 * | 9/2006 | Grassbaugh | F04C 28/265 418/55.6 |
| 2013/0251575 | A1 * | 9/2013 | Roof | F04C 29/126 418/55.4 |
| 2014/0023541 | A1 * | 1/2014 | Heidecker | B29D 99/0053 418/55.4 |
| 2015/0316058 | A1 * | 11/2015 | Jin | F04C 29/122 418/55.4 |
| 2017/0045049 | A1 * | 2/2017 | Park | F04C 28/16 |
| 2021/0131427 | A1 * | 5/2021 | Cho | F04C 28/06 |

FOREIGN PATENT DOCUMENTS

| | | |
|---|---|---|
| EP | 3334936 | 6/2018 |
| EP | 3657018 | 5/2020 |
| JP | 6-336986 | 12/1994 |
| JP | 4816172 | 11/2011 |
| KR | 10-0869930 | 11/2008 |
| KR | 10-1014264 | 2/2011 |
| KR | 10-1308776 | 9/2013 |
| KR | 10-2017-0019098 | 2/2017 |
| WO | 2017/026744 | 2/2017 |
| WO | 2019/045454 | 3/2019 |

OTHER PUBLICATIONS

Chinese Office Action dated Oct. 11, 2021 in Chinese Patent Application No. 202010354852.6.

* cited by examiner

SCROLL COMPRESSOR

CROSS-REFERENCE TO RELATED APPLICATIONS

This application is based on and claims priority under 35 U.S.C. § 119 to Korean Patent Applications No. 10-2019-0049996, filed on Apr. 29, 2019 and No. 10-2020-0016651, filed on Feb. 11, 2020, in the Korean Intellectual Property Office, the disclosures of which are incorporated by reference herein in their entireties.

BACKGROUND

1. Field

The disclosure relates to a scroll compressor with improved compression drive efficiency and structural assembly performance.

2. Description of the Related Art

A compressor is a mechanical device that uses a motor, a turbine, or the like to compress air, refrigerant, or other various working gases to increase the pressure thereof. The compressor may be used in various ways throughout the industry. When used in a refrigerant cycle, the compressor may convert low pressure refrigerant into high pressure refrigerant, and then transfer it back to a condenser.

The compressor may be classified into a reciprocating compressor in which a compression space which a working gas is absorbed into and discharged from is formed between a piston and a cylinder and the piston reciprocates linearly inside the cylinder to compress refrigerant, a rotary compressor in which a compression space which a working gas is absorbed into and discharged from is formed between an eccentrically rotating rolling piston and a cylinder and the rolling piston is eccentrically rotated along the inner wall of the cylinder to compress the refrigerant, and a scroll compressor in which a compression space which a working gas is absorbed into and discharged from is formed between an orbiting scroll and a fixed scroll and the orbiting scroll is rotated relative to the fixed scroll to compress the refrigerant.

The scroll compressor is widely used in refrigeration cycle equipment because of its higher efficiency, lower vibration and noise, smaller size, and lighter weight than the reciprocating compressor or the rotary compressor.

However, in the compression process of the scroll compressor, the refrigerant in the compression space may be overcompressed, and the overcompressed refrigerant may reduce the compression efficiency of the scroll compressor.

In order to solve this problem, the scroll compressor may have a differential pressure valve. However, there is a problem in that a separate differential pressure valve has to be provided and the differential pressure valve has to be periodically replaced due to durability of the differential pressure valve.

In addition, due to the complexity of the structure forming the scroll compressor, there is a problem that the assembly performance of the scroll compressor is degraded and the production efficiency thereof is lowered.

SUMMARY

An aspect of the disclosure is to provide a scroll compressor with improved compression drive efficiency and structural assembly performance.

According to an aspect of the disclosure, a scroll compressor may include: a main body; a cover configured to divide an inside of the main body into a low pressure section and a high pressure section; a fixed scroll disposed in the low pressure section and including a first discharge port through which refrigerant, compressed by the scroll compressor, is discharged; an orbiting scroll configured to rotate with respect to the fixed scroll and form a compression chamber together with the fixed scroll; a discharge guide disposed between the fixed scroll and the cover, the discharge guide including a second discharge port connected to the first discharge port and guiding a compressed refrigerant in the compression chamber to the cover; and a back pressure actuator disposed to surround an outer circumferential surface of the discharge guide to form a back pressure chamber together with the discharge guide and configured to move in a direction toward the cover with respect to the discharge guide to selectively connect the second discharge port with the high pressure section, wherein the fixed scroll may include a bypass flow path formed in the fixed scroll and connecting the compression chamber to the second discharge port; and a bypass valve configured to selectively open or close the bypass flow path.

The scroll compressor may include a sealer disposed between the back pressure actuator and the discharge guide and configured to selectively open or close a gap between the back pressure actuator and the discharge guide, wherein the sealer may include a cut part having an inclined surface at a selected angle.

The cut part may include a first cut part including a first inclined surface; and a second cut part including a second inclined surface disposed to face the first inclined surface, wherein when a first pressure in the back pressure chamber is greater than a second pressure in the second discharge port, the first inclined surface and the second inclined surface are spaced apart from each other, so that the refrigerant flows therebetween, and wherein when the first pressure in the back pressure chamber is smaller than the second pressure in the second discharge port, the first inclined surface and the second inclined surface are in contact with each other to prevent the refrigerant from flowing therebetween.

The scroll compressor may include a sealer disposed between the back pressure actuator and the discharge guide and configured to selectively close a gap between the back pressure actuator and the discharge guide, wherein the sealer includes a Teflon seal having a refrigerant flow path and an O-ring coupled to an outer circumferential surface of the Teflon seal to selectively open and close the refrigerant flow path.

The refrigerant flow path may include a refrigerant groove formed on an inner circumferential surface of the Teflon seal; an outlet formed on an upper surface of the Teflon seal and in fluid communication with the refrigerant groove; and a connecting hole formed to communicate the outer circumferential surface of the Teflon seal with the refrigerant groove.

BRIEF DESCRIPTION OF THE DRAWINGS

These and/or other aspects and advantages of the disclosure will become apparent and more readily appreciated from the following description of the embodiments, taken in conjunction with the accompanying drawings of which.

DETAILED DESCRIPTION

Hereinafter, preferred embodiments of the disclosure will be described with reference to the accompanying drawings, for comprehensive understanding of the constitution and the effect of the disclosure. Meanwhile, it should be noted that the disclosure is not limited to the embodiments described herein, but may be implemented in various forms, and various modifications may be made to the embodiments of the disclosure. The descriptions of the embodiments of the disclosure are provided just to make the descriptions of the disclosure complete, and to make people having ordinary knowledge in the technical field to which the disclosure belongs fully understand the range of the invention. Meanwhile, in the accompanying drawings, components were illustrated in more enlarged sizes than their actual sizes for the convenience of description, and the proportion of each component may be exaggerated or reduced.

Also, in case it is described that a component is "on top of" or "contacts" another component, it should be understood that a component may directly contact or be connected with the top portion of another component, but still another component may exist between the components. In contrast, in case it is described that a component is "just on top of" or "directly contacts" another component, it may be understood that still another component does not exist between the components. Other expressions describing relations between components, for instance, expressions such as "between ~" and "directly between ~" may be interpreted in the same manner.

Further, terms such as "first," "second" and the like may be used to describe various elements, but the elements are not intended to be limited by the terms. Such terms are used only for distinguishing one element from another element. For example, a first element may be called a second element, and a second element may be called a first element in a similar manner, without departing from the scope of the disclosure.

Singular expressions include plural expressions, unless defined obviously differently in the context. Also, terms such as "include" or "have" should be construed as designating that there are such characteristics, numbers, steps, operations, elements, components or a combination thereof described in the specification, and may be interpreted to denote that one or more of other characteristics, numbers, steps, operations, elements, components or a combination thereof may be added.

The terms used in the embodiments of the disclosure may be interpreted as meanings generally known to those of ordinary skill in the art described in the disclosure, unless defined differently in the disclosure.

Hereinafter, the structure of a scroll compressor 1 according to an embodiment of the disclosure will be described with reference to FIGS. 1 to 4.

Figure 1:
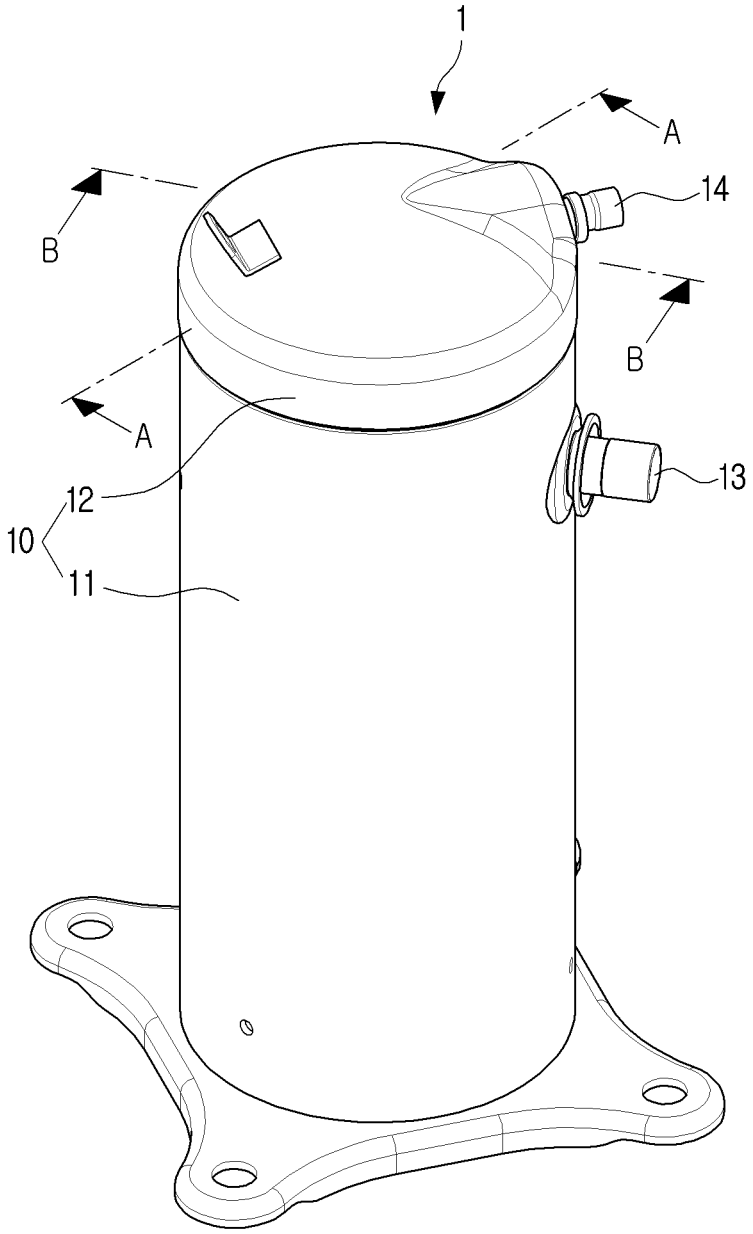
FIG. 1 is a perspective view illustrating a scroll compressor according to an embodiment of the disclosure.
Figure 2:
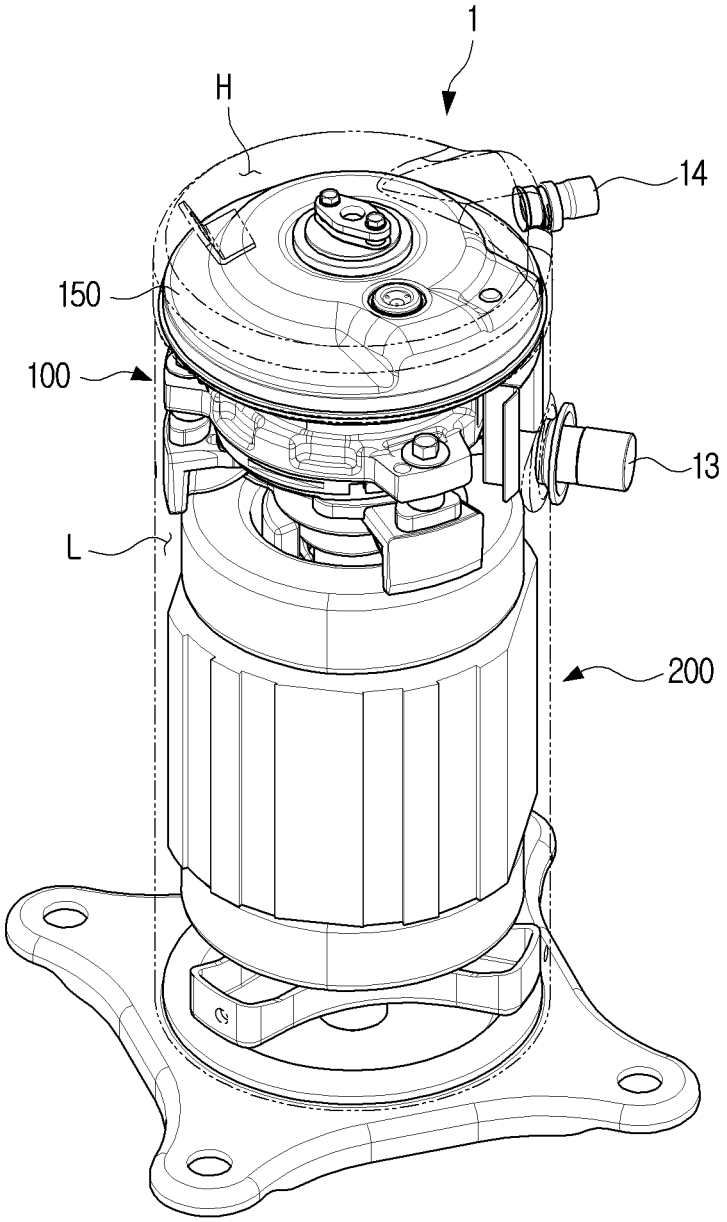
FIG. 2 is a perspective view illustrating a state in which a main body is transparent in the scroll compressor of FIG. 1.
Figure 3:
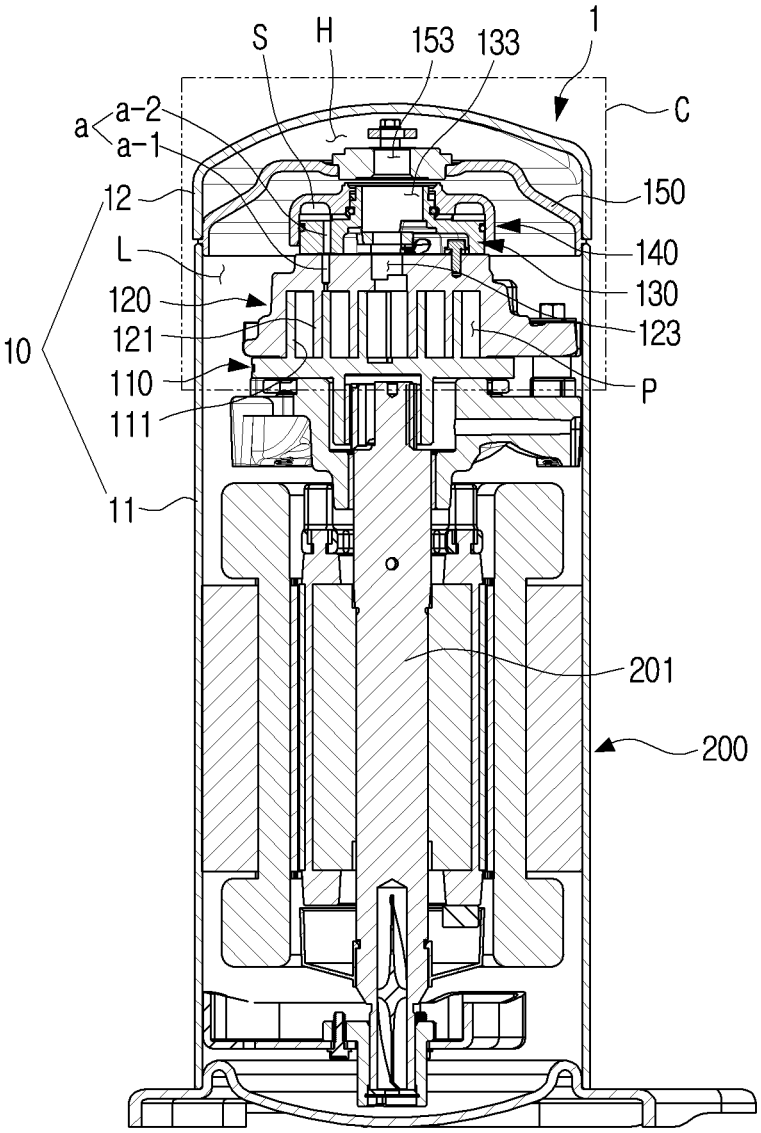
FIG. 3 is a cross-sectional view taken along the line A-A of FIG. 1.
Figure 4:
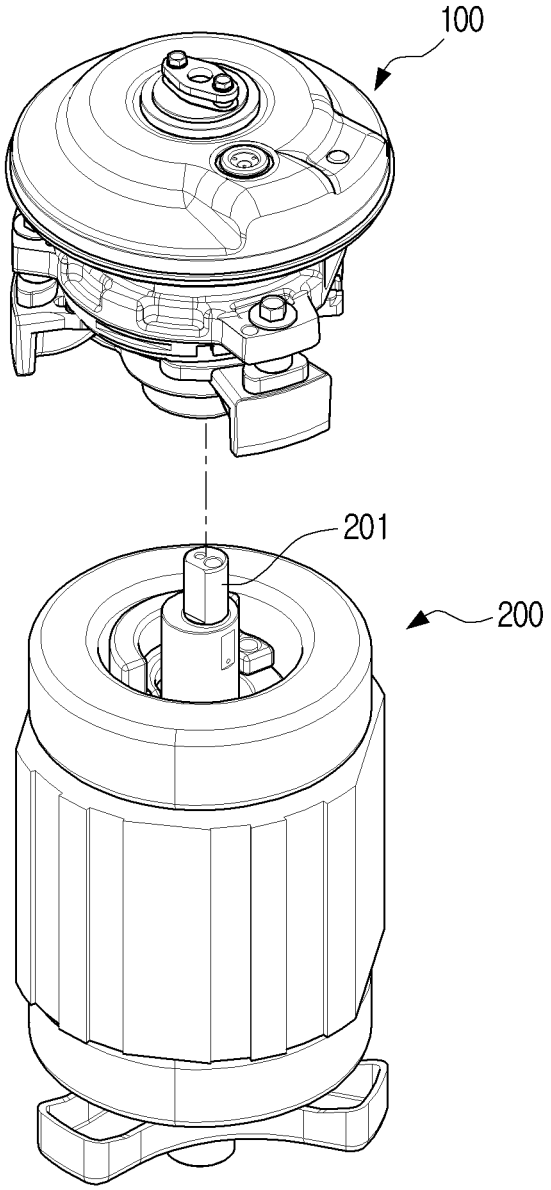
FIG. 4 is an exploded perspective view illustrating a scroll compressor in which a main body is omitted and a compression part and a motor part are separated.

FIG. 1 is a perspective view illustrating a scroll compressor 1 according to an embodiment of the disclosure. FIG. 2 is a perspective view illustrating a state in which a main body 10 is transparent in the scroll compressor 1 of FIG. 1. FIG. 3 is a cross-sectional view taken along the line A-A of FIG. 1. FIG. 4 is an exploded perspective view illustrating a scroll compressor 1 in which a main body 10 is omitted and a compression part 100 and a motor part 200 are separated.

The scroll compressor 1 is a device configured to compress a refrigerant through a scroll method, and may include a main body 10 forming an external appearance, a compression part 100 disposed inside the main body 10 to compress the refrigerant, and a motor part 200 disposed inside the main body 10 and connected to the compression part 100 to drive the compression part 100.

The main body 10 forms an overall appearance of the scroll compressor 1 and may include a first main body 11 provided with a refrigerant inlet 13 into which the refrigerant flows and a second main body 12 provided with a refrigerant outlet 14.

The main body 10 is formed by coupling the first main body 11 and the second main body 12, and the inside of the main body 10 may be sealed except for the refrigerant inlet 13 and the refrigerant outlet 14. In other words, the refrigerant may pass through the main body 10 only through the refrigerant inlet 13 and the refrigerant outlet 14.

In addition, the inner space of the main body 10 may be partitioned by a high and low pressure cover 150 to form a low pressure section L and a high pressure section H. In detail, as illustrated in FIG. 2, the first main body 11 and the high and low pressure cover 150 may form the low pressure section L inside the main body 10, and the second main body 12 and the high and low pressure cover 150 may form the high pressure section H inside the main body 10.

Here, the low pressure section L and the high pressure section H refer to sections where the pressure difference occurs based on the high and low pressure cover 150 when the scroll compressor 1 operates. When the scroll compressor 1 does not operate, the pressure of the low pressure section L and the high pressure section H may be the same.

Accordingly, the refrigerant flowing through the scroll compressor 1 may be introduced into the main body 10 through the refrigerant inlet 13, may be compressed by the compression part 100 and the motor part 200 disposed inside the main body 10, and then may be discharged to the outside of the main body 10.

The compression part 100 may be disposed in the low pressure section L inside the main body 10, and may compress the refrigerant introduced into the main body 10. The detailed structure of the compression part 100 will be described later with reference to FIG. 5.

The motor part 200 may be disposed in the low pressure section L inside the main body 10 and may be connected to the compression part 100 through a motor shaft 201 to provide a driving force for compressing the refrigerant.

In detail, the motor part 200 may be connected to an orbiting scroll 110 through the motor shaft 201 to rotate the orbiting scroll 110.

The motor part 200 may be disposed inside the main body 10 to transmit a driving force to the compression part 100, and may be implemented by various drive devices such as an electric motor, a turbine, and the like.

Hereinafter, a detailed structure of the compression part 100 will be described with reference to FIG. 5.

Figure 5:
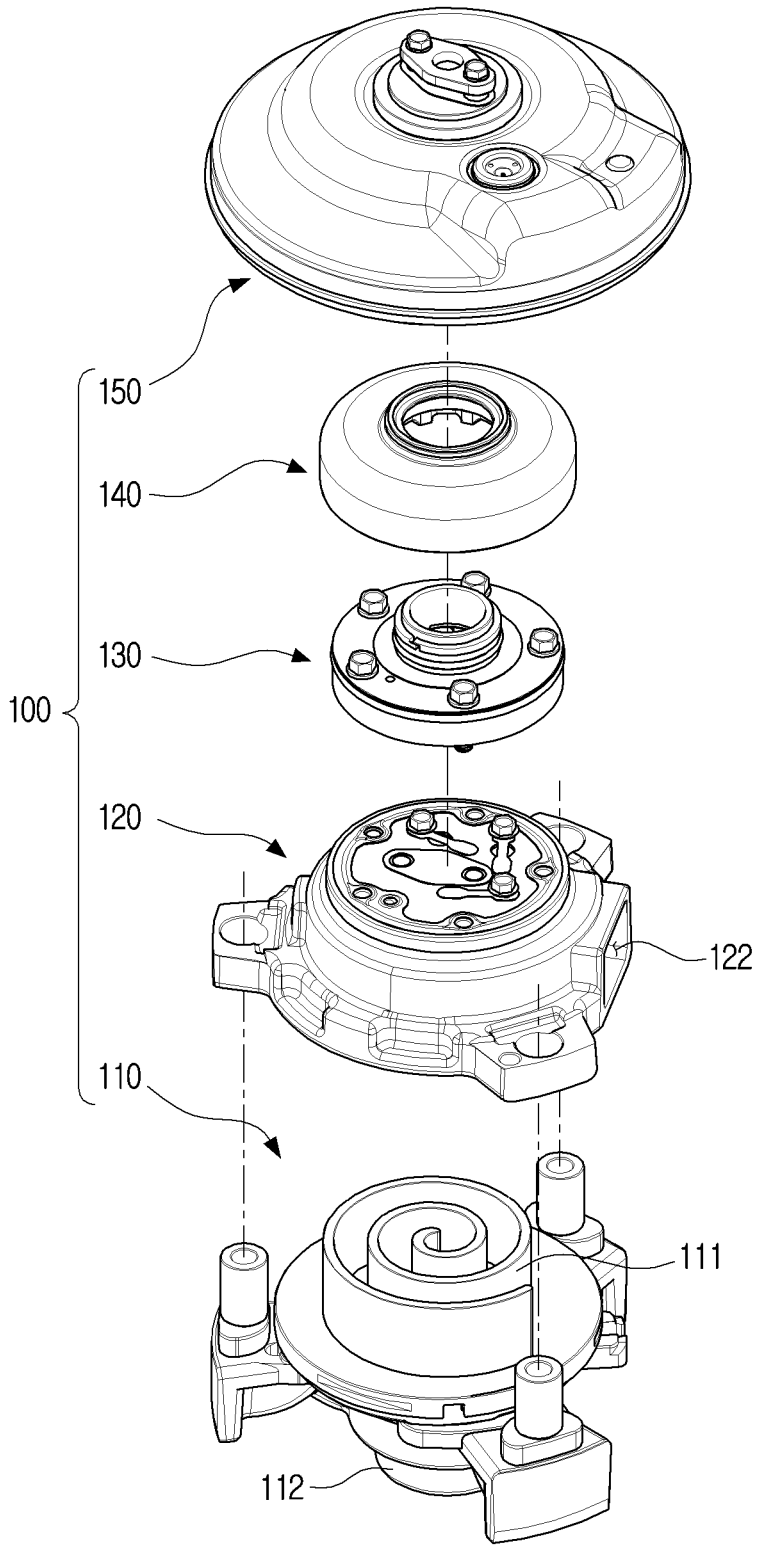
FIG. 5 is an exploded perspective view illustrating a compression part according to an embodiment of the disclosure.

FIG. 5 is an exploded perspective view illustrating a compression part 100 according to an embodiment of the disclosure.

The compression part 100 of the scroll compressor 1 may include the orbiting scroll 110 which is disposed in the low pressure section L of the main body 10 and connected to the motor part 200 to rotate relatively with respect to a fixed scroll 120 while engaging with the fixed scroll 120, the fixed scroll 120 which is fixedly disposed inside the main body 10 and forms a compression chamber P together with the orbiting scroll 110, a discharge guide 130 which is disposed above the fixed scroll 120 and configured to guide the refrigerant compressed in the compression chamber P to the high pressure section H, a back pressure actuator 140 which is disposed to cover the upper portion of the discharge guide 130 and configured to selectively contact the high and low pressure cover 150, and the high and low pressure cover 150 configured to divide the inside of the main body 10 into the low pressure section L and the high pressure section H.

The orbiting scroll 110 is disposed inside the main body 10 by a fixing part 112 and connected to the motor shaft 201 of the motor part 200 to rotate in a selected direction.

The orbiting scroll 110 is coupled to the fixed scroll 120 to form the compression chamber P. The orbiting scroll 110 rotates relative to the fixed scroll 120, thereby compressing the refrigerant in the compression chamber P.

In detail, the orbiting scroll 110 may include an orbiting wrap 111 formed in a spiral shape, and the orbiting wrap 111 may be engaged with a fixed wrap 121 of the fixed scroll 120 to form the compression chamber P.

Hereinafter, the detailed structure of the fixed scroll 120 according to an embodiment of the disclosure will be described with reference to FIGS. 6 and 7.

Figure 6:
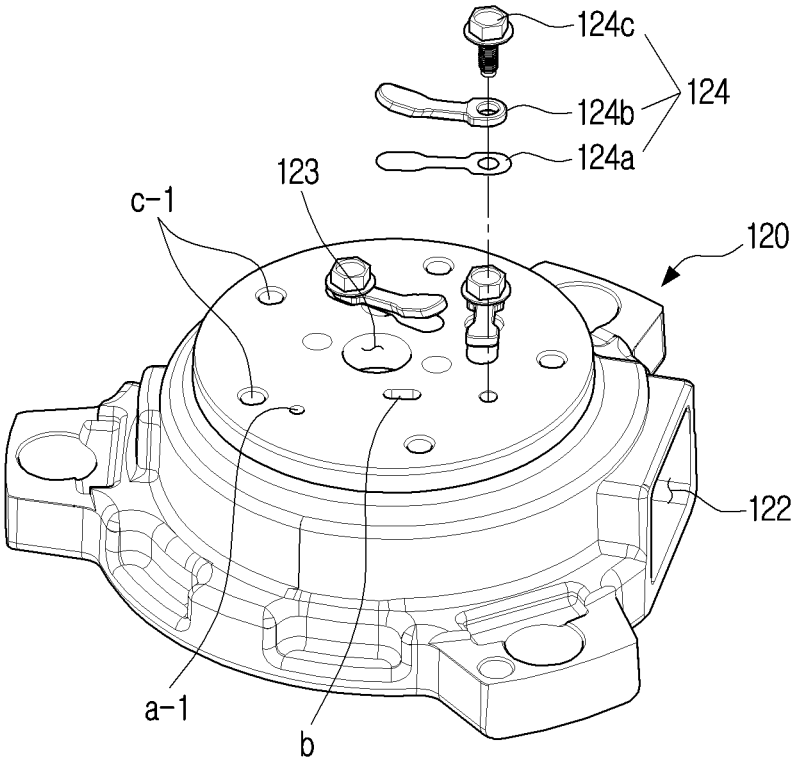
FIG. 6 is an exploded perspective view illustrating a fixed scroll according to an embodiment of the disclosure.

FIG. 6 is an exploded perspective view illustrating a fixed scroll 120 according to an embodiment of the disclosure. FIG. 7 is a bottom view illustrating a fixed scroll 120 according to an embodiment of the disclosure.

The fixed scroll 120 is disposed in the low pressure section L of the main body 10, and may include the fixed wrap 121 formed on the bottom surface of the fixed scroll 120, a first inlet 122 configured to guide the refrigerant inside the low pressure section L to the compression chamber P, and a first discharge port 123 through which the refrigerant compressed in the compression chamber P is discharged.

The first inlet 122 is formed on a side surface of the fixed scroll 120 and may be in fluid communication with the compression chamber P.

The first discharge port 123 may be formed in the upper portion of the fixed scroll 120, and may be formed in the center of the compression chamber P. In other words, the compression chamber P may be formed as a space between the fixed wrap 121 and the orbiting wrap 111 which are formed in a spiral shape and engaged with each other. The first discharge port 123 may be formed at the center of the fixed scroll 120.

When the orbiting scroll 110 rotates, the refrigerant introduced into the first inlet 122 is compressed by the compression chamber P between the fixed wrap 121 and the orbiting wrap 111, so that the pressure of the refrigerant is increased. The compressed refrigerant may be discharged to the outside through the first discharge port 123.

Accordingly, the refrigerant in the low pressure section L is introduced into the compression chamber P through the first inlet 122, and the refrigerant compressed in the compression chamber P moves to the discharge guide 130 through the first discharge port 123.

Figure 7:
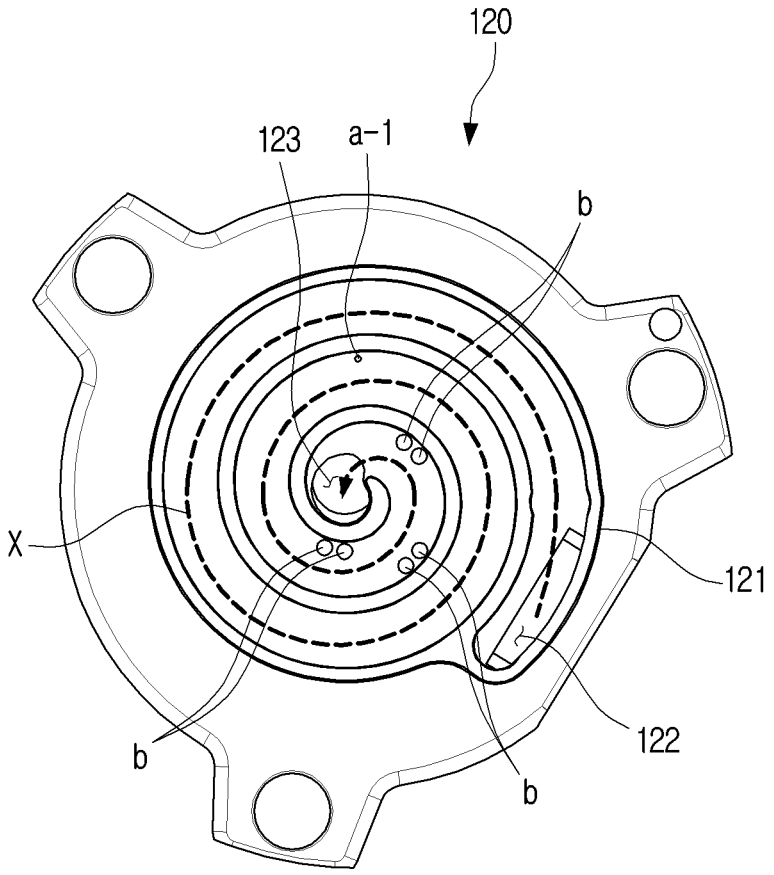
FIG. 7 is a bottom view illustrating a fixed scroll according to an embodiment of the disclosure.

In other words, as illustrated in FIG. 7, the refrigerant introduced into the first inlet 122 may move along a spiral compression channel X, and then be discharged through the first discharge port 123.

The fixed scroll 120 may include a first back pressure flow path a-1 which is spaced apart from the first discharge port 123, is in fluid communication with the compression chamber P, and is formed in the upper portion of the fixed scroll 120. In addition, the fixed scroll 120 may include a bypass flow path b formed near the center of the upper portion of the fixed scroll 120 to communicate the compression chamber P and a second discharge port 133 of the discharge guide 130 and a bypass valve 124 configured to open and close the bypass flow path b.

In detail, the first back pressure flow path a-1 is connected to a second back pressure flow path a-2 of the discharge guide 130, and forms a back pressure flow path a together with the second back pressure flow path a-2.

Here, the back pressure flow path a is disposed spaced apart from the first discharge port 123, is formed in a position not to interfere with the fixed wrap 121, and may guide some of the compressed refrigerant in the compression chamber P to a back pressure chamber S formed by the discharge guide 130 and the back pressure actuator 140.

In other words, the back pressure flow path a may communicate the compression chamber P and the back pressure chamber S. Accordingly, during initial operation of the scroll compressor 1, the back pressure flow path a may allow some refrigerant in the compression chamber P to flow into the back pressure chamber S and quickly fill the low pressure section L with a selected pressure, so that the initial torque required for operation of the scroll compressor 1 is reduced.

Here, the initial torque may refer to power required for initial operation of the motor part 200 required until the low pressure section L is filled with the selected pressure to bring the back pressure actuator 140 into contact with the high and low pressure cover 150.

In addition, the back pressure flow path a is not connected to the first discharge port 123, so that the refrigerant does not directly move between each other.

In addition, the back pressure flow path a may increase the pressure in the back pressure chamber S by flowing the refrigerant compressed in the compression chamber P, so that the back pressure actuator 140 is moved upward.

Accordingly, the back pressure flow path a may not only move the back pressure actuator 140 but also greatly reduce the initial load power of the scroll compressor 1.

The bypass flow path b may be spaced apart from the first discharge port 123 and may be formed at a position that does not interfere with the spiral fixed wrap 121. Accordingly, the compressed refrigerant in the compression chamber P may flow to the second discharge port 133 of the discharge guide 130 not only through the first discharge port 123 of the fixed scroll 120 but also through the bypass flow path b.

Accordingly, the compressed refrigerant in the compression chamber P may flow to the second discharge port 133 of the discharge guide 130 through the bypass flow path b as well as the first discharge port 123 of the fixed scroll 120.

When the refrigerant is overcompressed while being compressed in the compression chamber P, the overcompressed refrigerant may be discharged to the second discharge port 133 through the bypass flow path b.

For example, as the refrigerant flows from the first inlet 122 to the first discharge port 123 of the compression chamber P, the pressure of the refrigerant increases, and the pressure of the refrigerant discharged from the first discharge port 123 may correspond to the required pressure of the scroll compressor 1.

At this time, the pressure of the refrigerant flowing in the compression chamber P may reach the required pressure of the scroll compressor 1 before reaching the first discharge port 123, which corresponds to the overcompressed refrigerant in the compression chamber P. This may reduce the compression efficiency of the scroll compressor 1.

The overcompressed refrigerant may be discharged from the compression chamber P before reaching the first discharge port 123 through the bypass flow path b formed in the upper surface of the fixed scroll 120.

Therefore, the bypass flow path b discharges the overcompressed refrigerant in the compression chamber P, thereby improving the compression efficiency of the scroll compressor 1 through a simple structure.

The bypass valve 124 is provided in the upper portion of the bypass flow path b so that when the refrigerant passing through the bypass flow path b corresponds to the required pressure of the scroll compressor 1, the bypass valve 124 may open the bypass flow path b.

In detail, the bypass valve 124 may include a bypass valve body 124*a* configured to be in contact with the bypass flow path b to open and close the bypass flow path b, a bypass valve stopper 124*b* configured to restrict the movement of the bypass valve body 124*a*, and a bypass valve fixing portion 124*c* configured to fix the bypass valve body 124*a* and the bypass valve stopper 124*b* to the fixed scroll 120.

The bypass valve body 124*a* is formed larger than the diameter of the bypass flow path b and may have a selected elasticity. For example, the elastic force of the bypass valve body 124*a* may correspond to the required pressure of the scroll compressor 1.

In detail, when the pressure of the refrigerant in the bypass flow path b is greater than the required pressure of the scroll compressor 1, the bypass valve body 124*a* is bent by the refrigerant in the bypass flow path b, thereby opening the bypass flow path b.

In addition, when the pressure of the refrigerant in the bypass flow path b is lower than the required pressure of the scroll compressor 1, the bypass valve body 124*a* contacts the bypass flow path b to block the bypass flow path b.

The bypass valve stopper 124*b* is formed to be bent at a selected angle, so that the bypass valve body 124*a* may be prevented from being bent above the selected angle in the state in which the bypass flow path b is opened.

In addition, the bypass valve stopper 124*b* may be provided with a portion fixed by a rivet together with the bypass valve body 124*a* on one side, and bent to be gradually upward from the one side to the other side.

In addition, a plurality of bypass flow paths b and a plurality of bypass valves 124 may be provided in the spiral flow pass of the fixed scroll 120. Accordingly, the overcompressed refrigerant in the compression chamber P may be discharged through the plurality of bypass flow paths b formed in the spiral flow path of the fixed scroll 120, thereby improving the compression efficiency of the scroll compressor 1.

In addition, the bypass valve 124 opens and closes the bypass flow path b depending on the pressure of the refrigerant in the bypass flow path b, and may prevent the refrigerant in the second discharge port 133 of the discharge guide 130 to backflow to the bypass flow path b.

The bypass valve fixing portion 124*c* fixes the bypass valve body 124*a* and the bypass valve stopper 124*b* to the fixed scroll 120, and may use a rivet, a bolt, a screw, and the like.

In addition, a plurality of coupling holes C-1 may be formed in the upper portion of the fixed scroll 120. The fixed scroll 120 may be stably coupled to the discharge guide 130 through the plurality of first coupling holes C-1.

Hereinafter, a detailed structure of the discharge guide 130 according to an embodiment of the disclosure will be described with reference to FIGS. 8 to 10.

Figure 8:
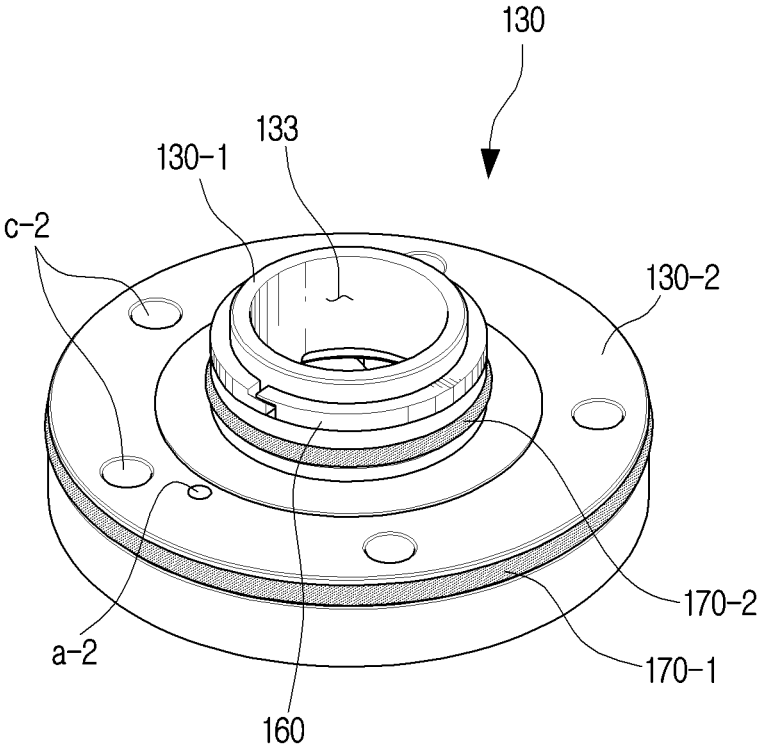
FIG. 8 is a perspective view illustrating a discharge guide according to an embodiment of the disclosure.

FIG. 8 is a perspective view illustrating a discharge guide 130 according to an embodiment of the disclosure. FIG. 9 is a perspective view illustrating the discharge guide 130 of FIG. 8 without a sealing member 160, a first O-ring member 170-1, and a second O-ring member 170-2. FIG. 10 is a bottom exploded perspective view of the discharge guide 130 of FIG. 8.

The discharge guide 130 may be disposed between the fixed scroll 120 and the high and low pressure cover 150 to guide the refrigerant compressed in the compression chamber P toward the high and low pressure cover 150.

In detail, the discharge guide 130 may include the second discharge port 133 connected to the first discharge port 123 to guide the compressed refrigerant in the compression chamber P to the high and low pressure cover 150, a first portion 130-1 forming the second discharge port 133, and a second portion 130-2 connected to the first portion 130-1 and having a diameter larger than the diameter of the first portion 130-1.

The second discharge port 133 is a hole penetrating the discharge guide 130, and the compressed refrigerant may flow through the second discharge port 133. The second discharge port 133 is formed from the second portion 130-2 to the first portion 130-1, and the second discharge port 133 may have a large diameter at the second portion 130-2 and a diameter smaller than that of the second portion 130-2 at the first portion 130-1.

The second discharge port 133 may be in fluid communication with the first discharge port 123 and the bypass flow paths b of the fixed scroll 120, and guide the refrigerant compressed to the required pressure of the scroll compressor 1 through the compression chamber P to a third discharge port 153 (see FIG. 18) of the high and low pressure cover 150.

In other words, the second discharge port 133 may be connected to the first discharge port 123 to guide the compressed refrigerant in the compression chamber P to the high and low pressure cover 150.

Figure 9:
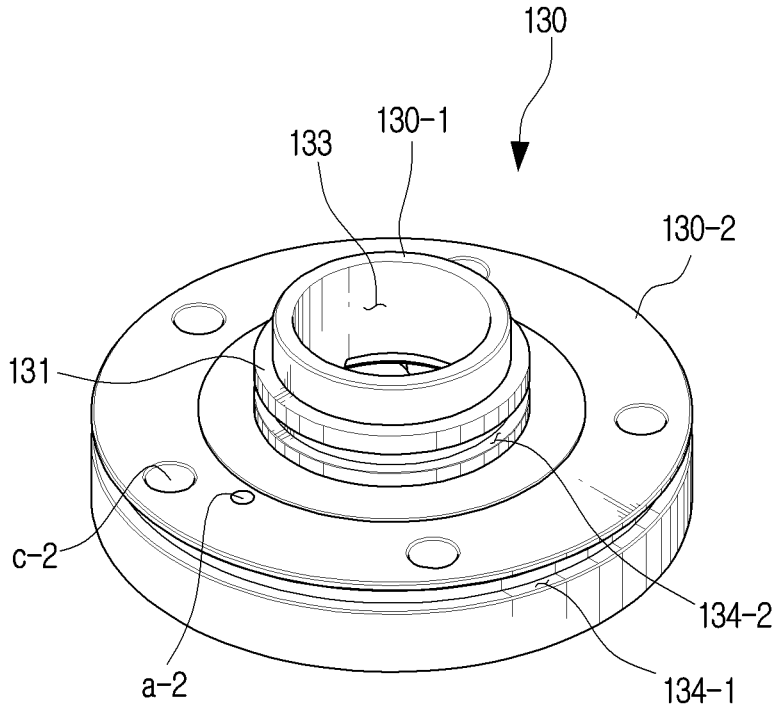
FIG. 9 is a perspective view illustrating the discharge guide of FIG. 8 without a sealing member, a first O-ring member, and a second O-ring member.

As illustrated in FIG. 9, the first portion 130-1 is a portion in which the second discharge port 133 is narrowed, and a first protrusion receiving portion 131 in which the sealing member 160 is disposed and a second accommodating portion 134-2 in which the second O-ring member 170-2 is accommodated may be formed on the outer circumferential surface of the first portion 130-1.

The second portion 130-2 has a larger diameter than the first portion 130-1, and a first accommodating portion 134-1 in which the first O-ring member 170-1 is accommodated may be formed in the outer circumferential surface of the second portion 130-2.

In addition, the second portion 130-2 may be provided with the second back pressure flow path a-2 separated from the second discharge port 133 and connected to the first back pressure flow path a-1.

In detail, the discharge guide 130 may include the second back pressure flow path a-2 which is formed to be spaced apart from the second discharge port 133 to penetrate the discharge guide 130 and communicates the first back pressure flow path a-1 and the back pressure chamber S.

Accordingly, when the second portion 130-2 is coupled to the fixed scroll 120 through a plurality of second coupling holes C-2 and the first coupling holes C-1 of the fixed scroll 120, the first back pressure flow path a-1 and the second back pressure flow path a-2 forms one flow path, so that the compression chamber P and the back pressure chamber S may be in fluid communication with each other.

In addition, the first portion 130-1 is partially inserted into a fourth discharge port 143 of the back pressure actuator 140, and the second portion 130-2 may be in contact with an extension portion 140-2 (see FIG. 16) of the back pressure actuator 140.

Accordingly, the discharge guide 130 may be partially inserted into an accommodation space 142 (see FIG. 14) of the back pressure actuator 140 to be connected to back pressure actuator 140.

Referring to FIG. 8 again, the discharge guide 130 may include the first O-ring member 170-1 disposed along the outer circumferential surface of the second portion 130-2 and sealing the gap between the back pressure actuator 140 and the second portion 130-2, and the second O-ring member 170-2 disposed along the outer circumferential surface of the first portion 130-1 and allowing the first portion 130-1 and the back pressure actuator 140 to be spaced apart from each other by a selected interval.

Figure 16:
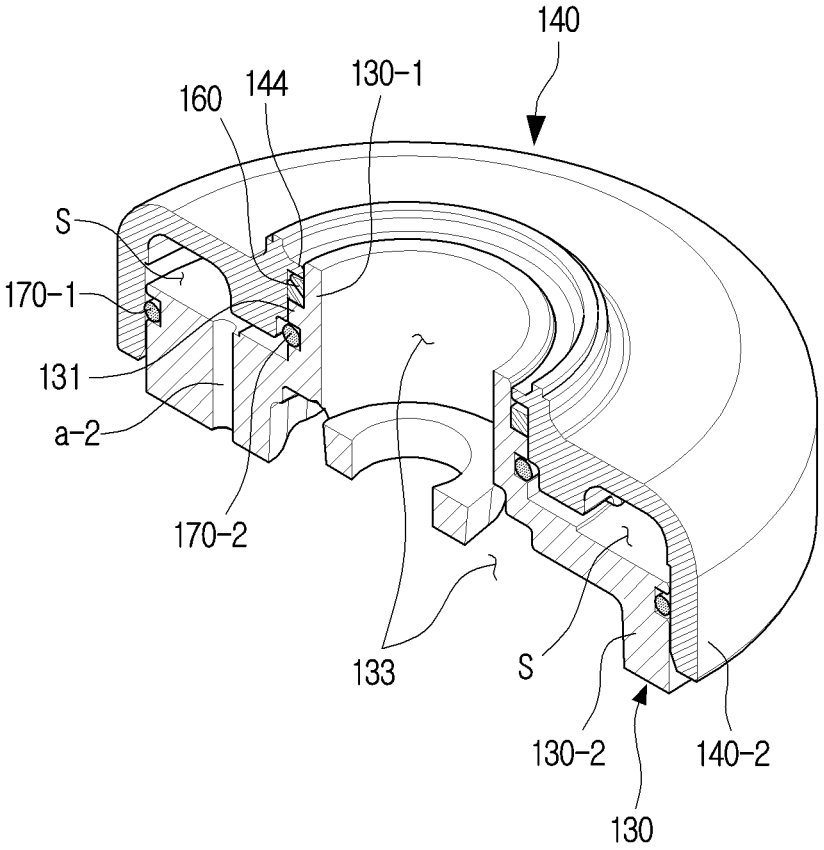
FIG. 16 is a cross-sectional perspective view illustrating a structure in which a discharge guide and a back pressure actuator according to an embodiment of the disclosure are coupled to each other.

In detail, as illustrated in FIG. 16, the first O-ring member 170-1 is disposed between the discharge guide 130 and the extension portion 140-2 of the back pressure actuator 140, thereby sealing the back pressure chamber S.

The first O-ring member 170-1 is a packing material of an annular shape, and may be made of synthetic rubber or fluorine resin. The first O-ring member 170-1 may be fitted to the first accommodating portion 134-1 of the second portion 130-2.

Figure 17:
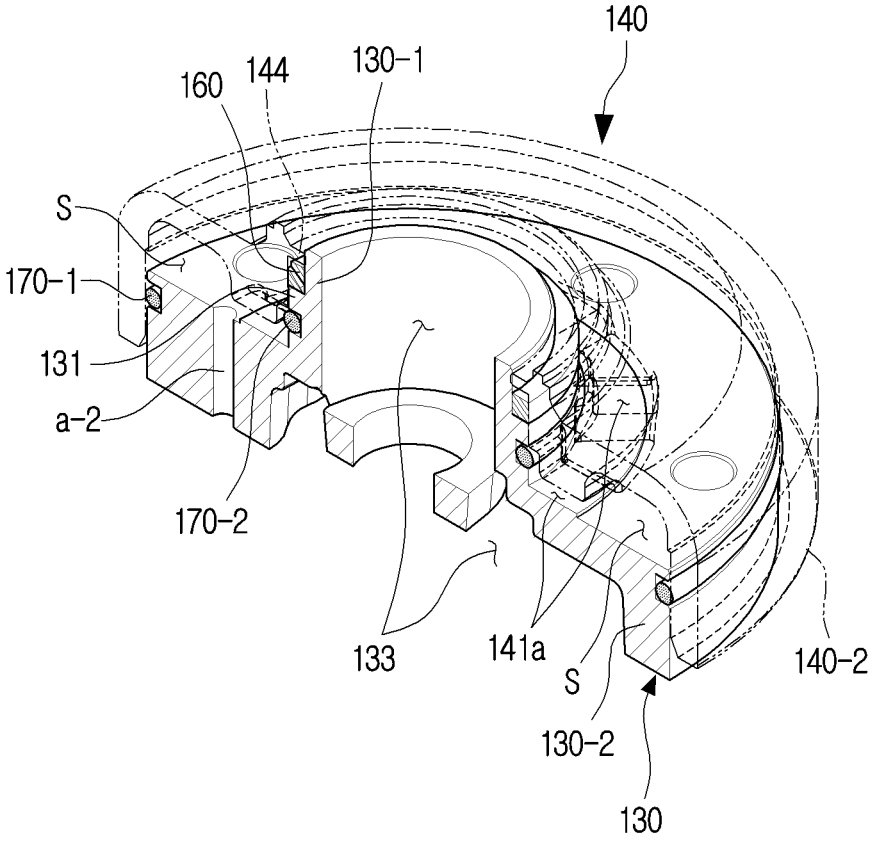
FIG. 17 is a cross-sectional perspective view illustrating the back pressure actuator in the structure of FIG. 16 transparently.

The detailed structure and function of the second O-ring member 170-2 will be described later with reference to FIGS. 16 and 17.

Figure 10:
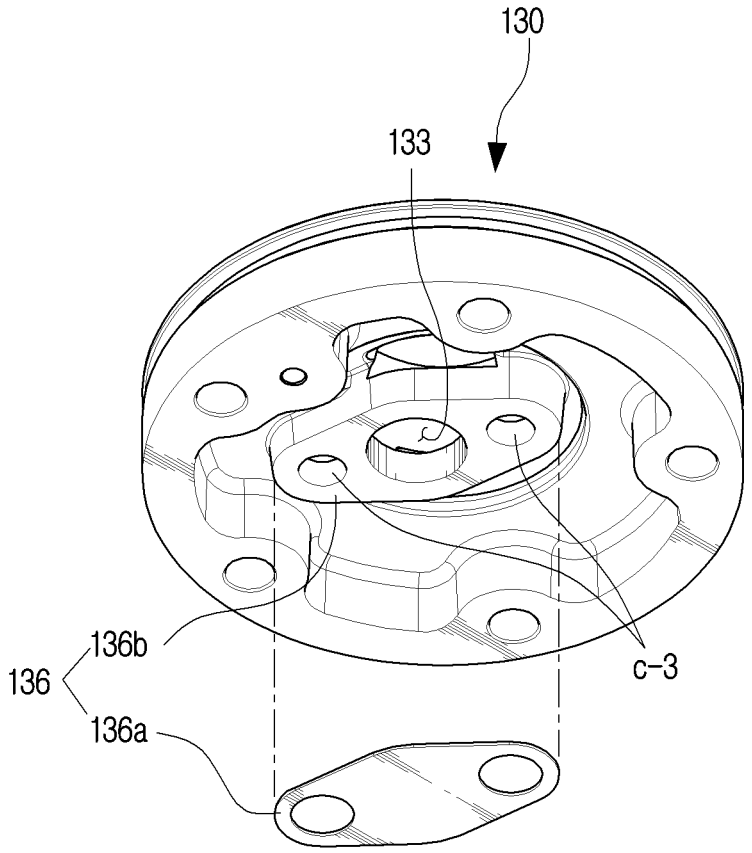
FIG. 10 is a bottom exploded perspective view of the discharge guide of FIG. 8.

As illustrated in FIG. 10, the discharge guide 130 may include a first check valve 136 disposed at the second discharge port 133 of the discharge guide 130 and configured to selectively open and close the first discharge port 123 of the fixed scroll 120.

Figure 19:
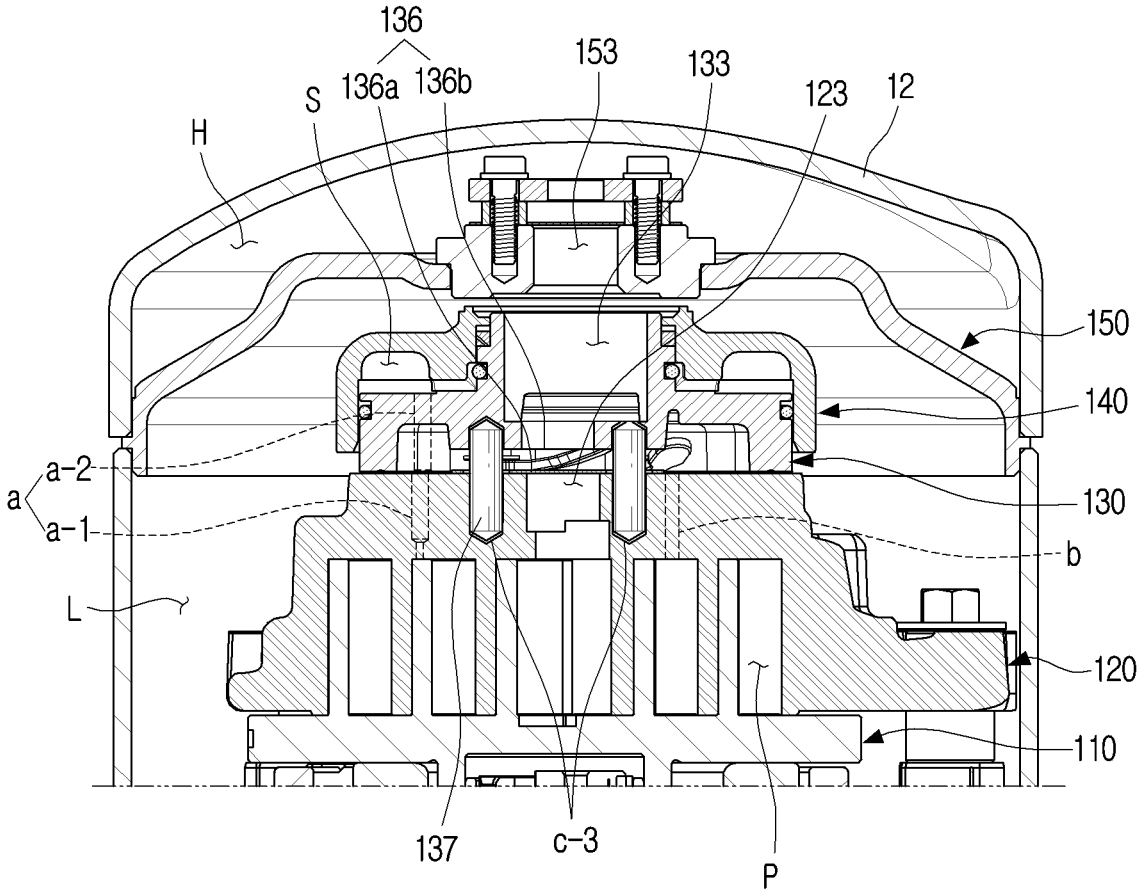
FIG. 19 is a cross-sectional view taken along the line B-B in FIG. 1.

In detail, as illustrated in FIGS. 10 and 19, the first check valve 136 may include a first check valve body 136*a* configured to open and close the first discharge port 123, a first check valve guide 137 connected to a plurality of third coupling holes C-3 to guide the vertical movement of the first check valve body 136*a*, and a first check valve stopper 136*b* configured to limit the movement of the first check valve body 136*a*.

Therefore, the first check valve body 136*a* may move up and down along the first check valve guide 137. The first check valve body 136*a* may be interfered by the fixed scroll 120 on the lower side, and may be limited by the first check valve stopper 136*b* formed integrally with the discharge guide 130 on the upper side.

Accordingly, the first check valve 136 may be formed so that when the pressure in the first discharge port 123 of the fixed scroll 120 is greater than the pressure in the second discharge port 133 of the discharge guide 130, the first check valve body 136*a* is moved upward by the refrigerant in the first discharge port 123, thereby opening the first discharge port 123.

In addition, when the pressure in the first discharge port 123 of the fixed scroll 120 is smaller than the pressure in the second discharge port 133 of the discharge guide 130, the first check valve body 136*a* may close the first discharge port 123, thereby preventing the refrigerant in the second discharge port 133 from flowing back to the first discharge port 123.

Accordingly, the first check valve 136 may selectively communicate the second discharge port 133 of the discharge guide 130 with the first discharge port 123 of the fixed scroll 120, thereby improving the compression efficiency of the scroll compressor 1 through a simple structure.

Hereinafter, a detailed structure of the sealing member 160 according to an embodiment of the disclosure will be described with FIGS. 11 and 12.

Figure 11:
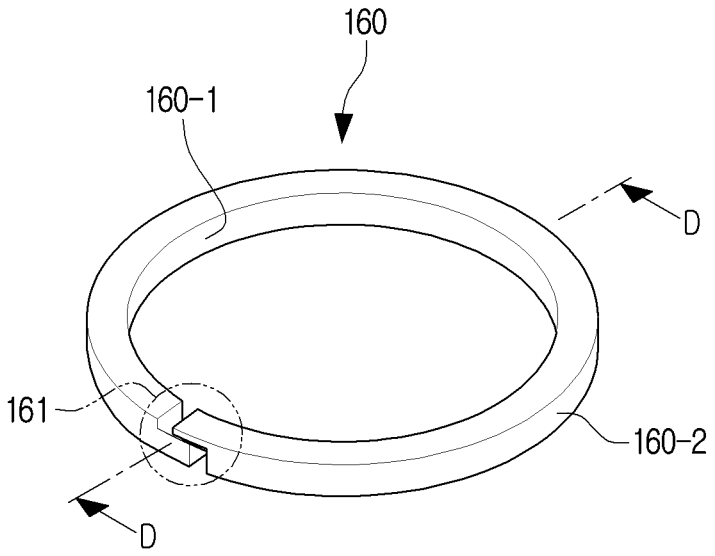
FIG. 11 is a perspective view illustrating a sealing member according to an embodiment of the disclosure.

FIG. 11 is a perspective view illustrating a sealing member 160 according to an embodiment of the disclosure. FIG. 12 is a cross-sectional view taken along the line D-D in FIG. 11.

The sealing member 160 is disposed between the back pressure actuator 140 and the discharge guide 130, and is configured to selectively close the gap G (see FIG. 20B) between the back pressure actuator 140 and the discharge guide 130.

In detail, the sealing member 160 may be disposed between the first portion 130-1 of the discharge guide 130 and the back pressure actuator 140.

In addition, the sealing member 160 is formed in an annular shape, and may include a cut portion 161 having inclined surfaces 162-1*a* and 162-2*a* at a selected angle.

The inner circumferential surface 160-1 of the sealing member 160 may contact the first portion 130-1 of the discharge guide 130, and the outer circumferential surface 160-2 of the sealing member 160 may contact the back pressure actuator 140.

Figure 12:
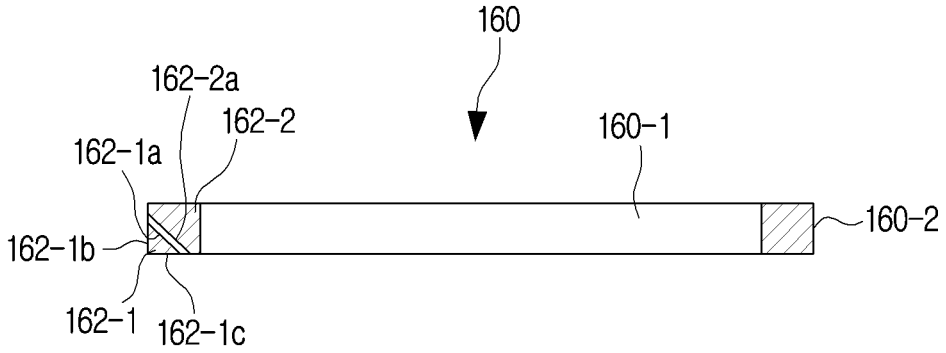
FIG. 12 is a cross-sectional view taken along the line D-D in FIG. 11.

In detail, as illustrated in FIG. 12, the cut portion 161 may include a first cut portion 162-1 having the first inclined surface 162-1*a* and a second cut portion 162-2 having the second inclined surface 162-2*a* disposed to face the first inclined surface 162-1*a*.

Here, the first inclined surface 162-1*a* and the second inclined surface 162-2*a* have complementary shapes. Accordingly, when the first inclined surface 162-1*a* and the second inclined surface 162-2*a* are in contact with each other, the refrigerant may not flow between the first inclined surface 162-1*a* and the second inclined surface 162-2*a*.

Figure 20A:
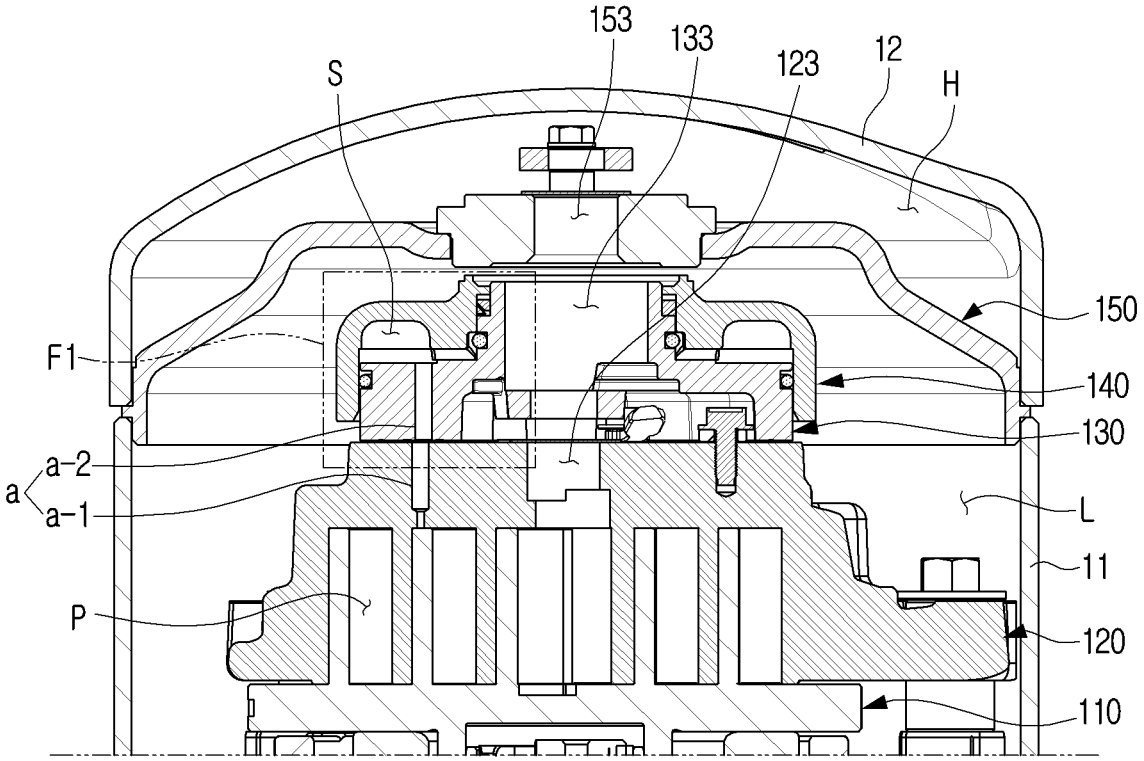
FIG. 20A is an enlarged view illustrating a region C of FIG. 3.
Figure 20B:
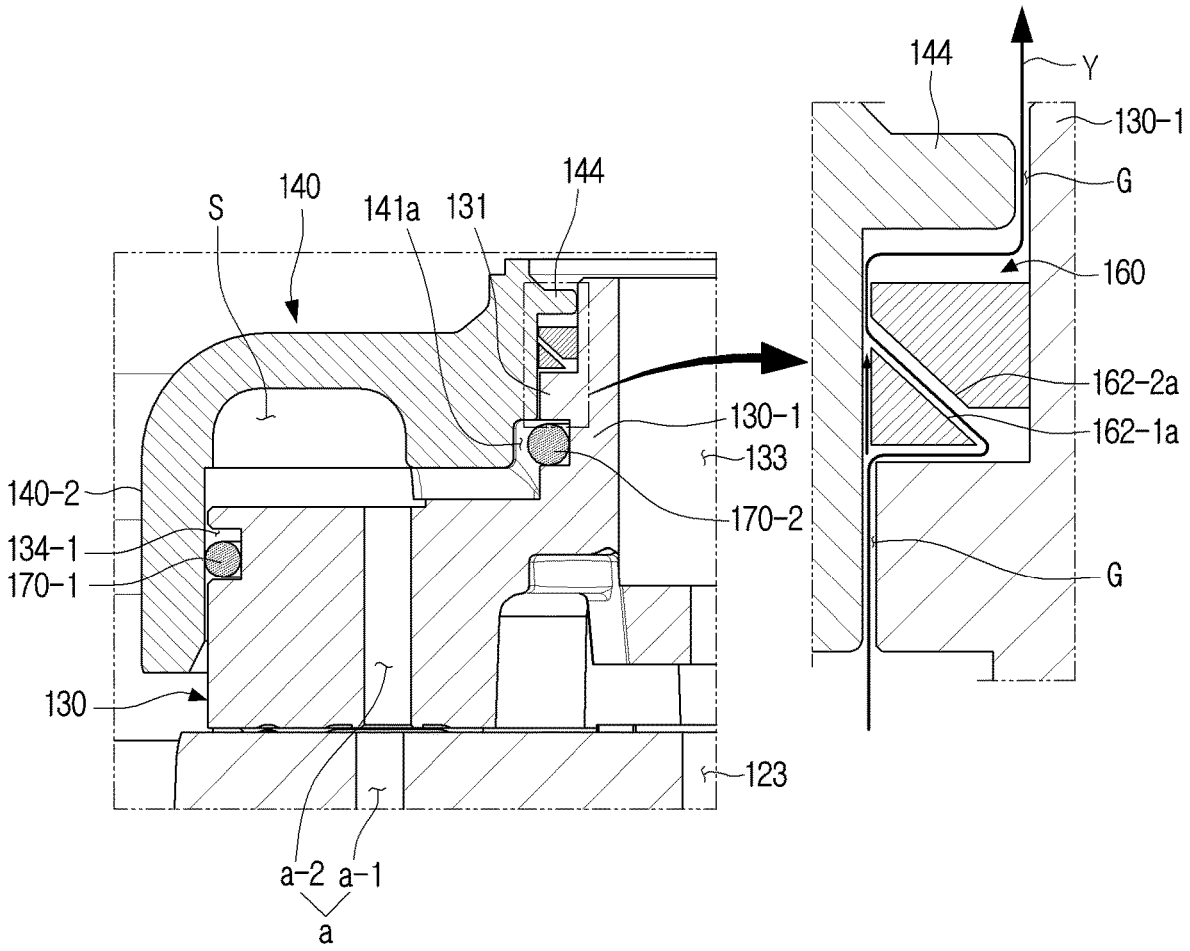
FIG. 20B is an enlarged view illustrating a region F1 of FIG. 20A.

For example, as illustrated in FIG. 20B, when the first pressure in the back pressure chamber S is greater than the second pressure in the second discharge port 133, the first inclined surface 162-1*a* and the second inclined surface 162-2*a* are spaced apart from each other so that the refrigerant can flow therebetween.

Figure 21A:
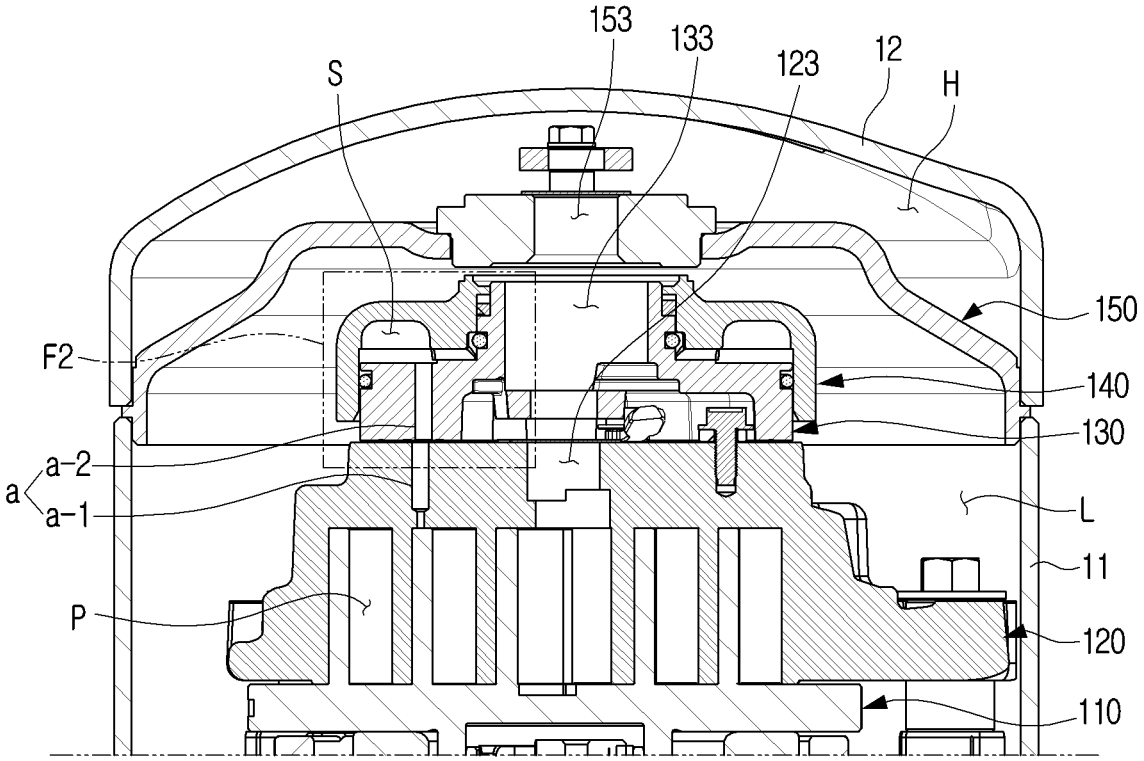
FIG. 21A is an enlarged view illustrating a second state according to driving of a scroll compressor according to an embodiment of the disclosure.
Figure 21B:
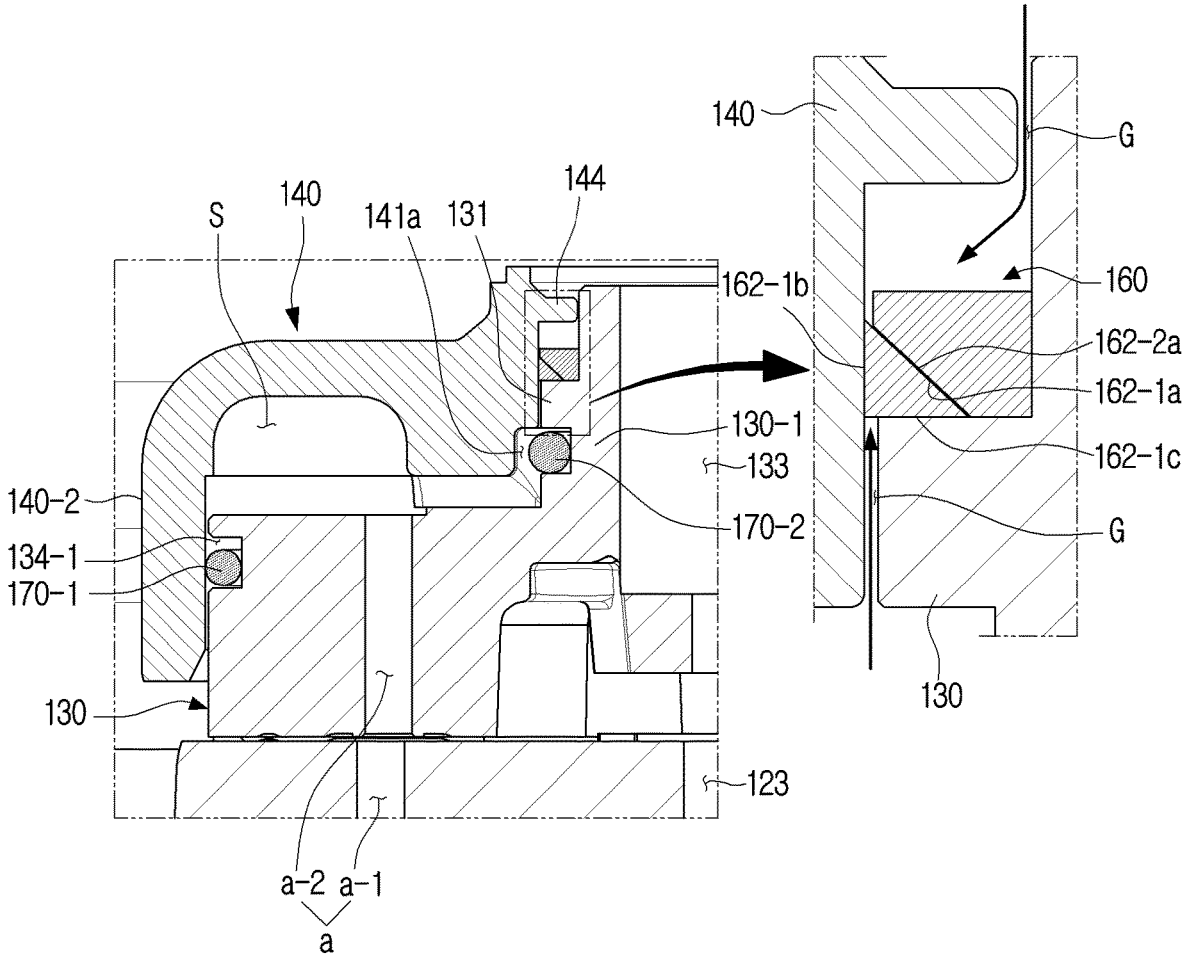
FIG. 21B is an enlarged view illustrating a region F2 of FIG. 21A.

In addition, as illustrated in FIG. 21B, when the first pressure in the back pressure chamber S is less than the second pressure in the second discharge port 133, the first inclined surface 162-1*a* and the second inclined surface 162-2*a* may contact each other to prevent the flow of the refrigerant.

In addition, the first cut portion 162-1 may include a first contact surface 162-1*b* contacting the back pressure actuator 140 and a second contact surface 162-1*c* selectively contacting the discharge guide 130.

Accordingly, when the first pressure in the back pressure chamber S is smaller than the second pressure in the second discharge port 133, the second contact surface 162-1*c* may contact the discharge guide 130. Therefore, the refrigerant in the back pressure chamber S may not flow to the second discharge port 133.

However, the disclosure is not limited thereto; therefore, the first contact surface 162-1*b* may selectively contact the back pressure actuator 140. For example, when the first pressure in the back pressure chamber S is smaller than the second pressure in the second discharge port 133, the first contact surface 162-1*b* may contact the back pressure actuator 140.

In other words, the sealing member 160 may selectively seal the gap G formed between the discharge guide 130 and the back pressure actuator 140.

The detailed operation of the sealing member 160 will be described later with reference to FIGS. 20A to 22B.

Hereinafter, a detailed structure of the back pressure actuator 140 according to an embodiment of the disclosure will be described with reference to FIGS. 13 to 17.

Figure 13:
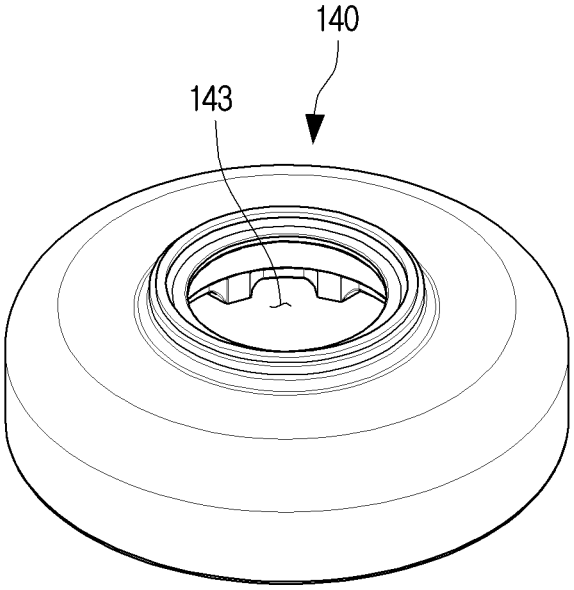
FIG. 13 is a perspective view illustrating a back pressure actuator according to an embodiment of the disclosure.
Figure 14:
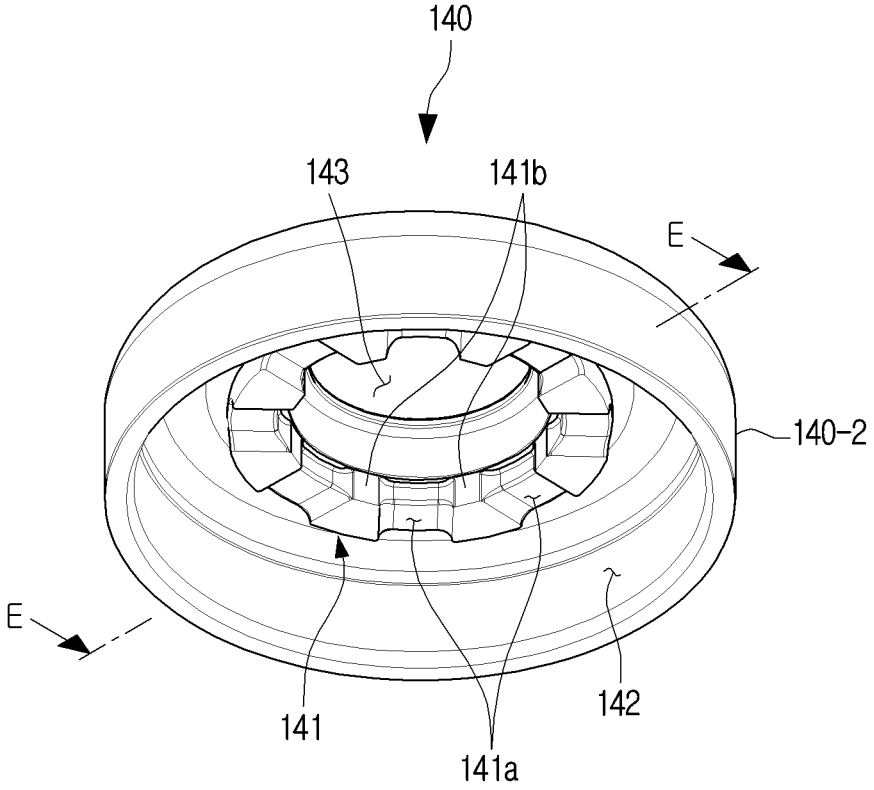
FIG. 14 is a bottom perspective view of FIG. 13.
Figure 15:
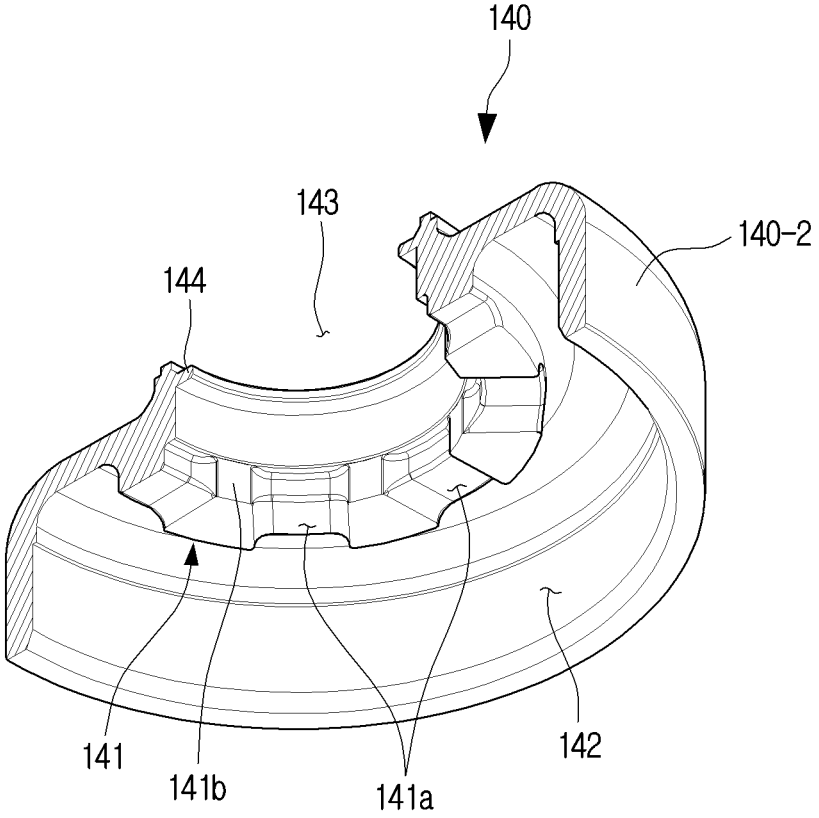
FIG. 15 is a cross-sectional perspective view taken along the line E-E in FIG. 14.

FIG. 13 is a perspective view illustrating a back pressure actuator 140 according to an embodiment of the disclosure. FIG. 14 is a bottom perspective view of FIG. 13. FIG. 15 is a cross-sectional perspective view taken along the line E-E in FIG. 14. FIG. 16 is a cross-sectional perspective view illustrating a structure in which a discharge guide 130 and a back pressure actuator 140 according to an embodiment of the disclosure are coupled. FIG. 17 is a cross-sectional perspective view illustrating the back pressure actuator 140 in the structure of FIG. 16 transparently.

The back pressure actuator 140 is disposed to surround the outer circumferential surface of the discharge guide 130 to form the back pressure chamber S together with the discharge guide 130, and may move upward and downward with respect to the discharge guide 130 to connect the second discharge port 133 and the high pressure section H.

The back pressure actuator 140 may include the accommodation space 142 into which the discharge guide 130 is inserted and which is configured to cover the first portion 130-1 and the second portion 130-2, a protrusion 141 which is formed in the accommodation space 142 and contacts the second O-ring member 170-2, and the fourth discharge port 143 configured to be connected to the second discharge port 133 of the discharge guide 130.

The back pressure actuator 140 may cover the upper portion and a portion of the side surface of the discharge guide 130, and may be coupled to the discharge guide 130 so that the back pressure actuator 140 slides in the vertical direction with respect to the discharge guide 130.

In detail, the protrusion 141 of the back pressure actuator 140 may be coupled to the first portion 130-1 of the discharge guide 130 through the second O-ring member 170-2. In addition, the extension portion 140-2 of the back pressure actuator 140 may be coupled to the second portion 130-2 of the discharge guide 130 through the first O-ring member 170-1.

The back pressure actuator 140 and the discharge guide 130 may be coupled so that the refrigerant in the back pressure chamber S formed by the back pressure actuator 140 and the discharge guide 130 flows through the gap G between the first portion 130-1 and the back pressure actuator 140 and the back pressure actuator 140 moves up and down with respect to the discharge guide 130.

At this time, the second O-ring member 170-2 may maintain the gap G between the first portion 130-1 and the back pressure actuator 140.

Accordingly, the refrigerant in the back pressure chamber S may flow to the second discharge port 133 through the gap G, but cannot flow between the extension portion 140-2 of the back pressure actuator 140 and the second portion 130-2 due to the first O-ring member 170-1.

The extension portion 140-2 may be extended to cover a portion of the side surface of the second portion 130-2 of the discharge guide 130 even when the back pressure actuator 140 moves upwards of the discharge guide 130 and contacts the high and low pressure cover 150.

However, the extension portion 140-2 may extend to such an extent that the extension portion 140-2 only covers a portion of the side surface of the second portion 130-2 of the discharge guide 130 and does not cover the fixed scroll 120.

Accordingly, the back pressure actuator 140 may be coupled to the discharge guide 130 by inserting the discharge guide 130 into the accommodation space 142 of the back pressure actuator 140 to cover the upper portion and the portion of the side surface of the discharge guide 130, so that the back pressure chamber S is formed and the back pressure actuator 140 is moved to selectively contact the high and low pressure cover 150.

In other words, when the scroll compressor 1 operates, the back pressure actuator 140 may be moved by the pressure in the back pressure chamber S to connect the third discharge port 153 of the high and low pressure cover 150 and the second discharge port 133. When the scroll compressor 1 is stopped, the back pressure actuator 140 may be spaced apart from the high and low pressure cover 150.

Accordingly, the compression efficiency of the scroll compressor 1 may be improved, and the production efficiency of the scroll compressor 1 may be improved due to the convenience of assembling the compression part 100. In other words, by inserting the discharge guide 130 into the accommodation space 142 of the back pressure actuator 140, the back pressure actuator 140 may be moved up and down with respect to the discharge guide 130 while forming the back pressure chamber S and the gap G.

In addition, the back pressure actuator 140 may include a second protrusion accommodating portion 144 protruding along the fourth discharge port 143. Accordingly, as illustrated in FIG. 16, the second protrusion accommodating portion 144 may form a space in which the sealing member 160 is accommodated together with the first protrusion receiving portion 131.

Here, the second protrusion accommodating portion 144 may protrude so as not to interfere with the first portion 130-1 of the discharge guide 130, and a gap G through which the refrigerant flows may be formed between the second protrusion accommodating portion 144 and the first portion 130-1.

The protrusion 141 may be formed to protrude in the accommodation space 142 to contact the second O-ring member 170-2.

In detail, the protrusion 141 may include refrigerant flow ports 141*a* configured to connect the back pressure chamber S and the gap G to allow the refrigerant to flow therebetween and O-ring contact surfaces 141*b* in contact with the second O-ring member 170-2 disposed on the outer circumferential surface of the first portion 130-1 of the discharge guide 130.

In addition, the refrigerant flow ports 141*a* may be radially formed at a selected interval in the protrusion 141. For example, the refrigerant flow ports 141*a* and the O-ring contact surfaces 141*b* may be alternately disposed in the protrusion 141.

Accordingly, the refrigerant in the back pressure chamber S may move to the gap G between the first portion 130-1 and the back pressure actuator 140 only through the refrigerant flow ports 141*a*. The gap between the O-ring contact surfaces 141*b* and the second O-ring member 170-2 is sealed, so that the refrigerant cannot move therebetween.

In addition, the O-ring contact surfaces 141*b* of the protrusion 141 may contact the second O-ring member 170-2, thereby separating the back pressure actuator 140 form the discharge guide 130.

In detail, the second O-ring member 170-2 may separate the back pressure actuator 140 from the first portion 130-1 of the discharge guide 130. Accordingly, when the back pressure actuator 140 moves relative to the discharge guide 130 as the scroll compressor 1 operates, the noise generated by the back pressure actuator 140 contacting the discharge guide 130 may be prevented.

Therefore, it is possible to improve the compression efficiency of the scroll compressor 1 and increase the ease of assembly thereof, and at the same time, greatly reduce the noise generated during operation of the scroll compressor 1.

Hereinafter, a detailed structure of the high and low pressure cover 150 will be described with reference to FIG. 18.

Figure 18:
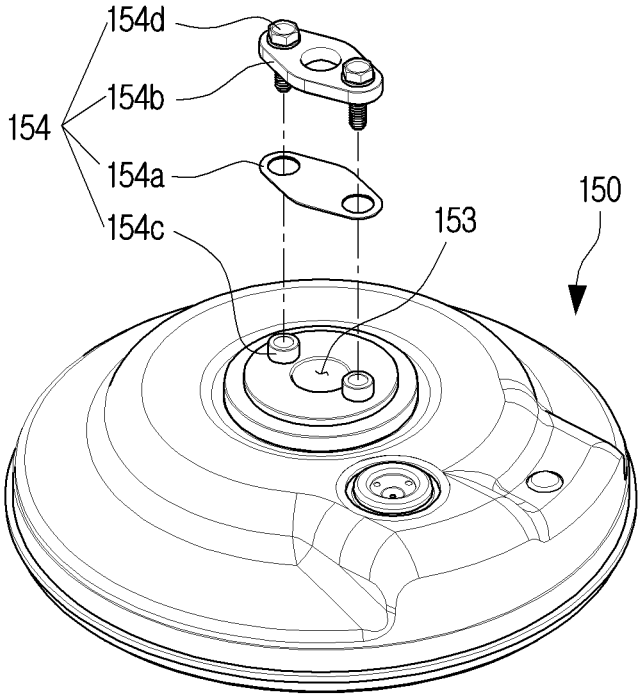
FIG. 18 is an exploded perspective view illustrating a high and low pressure cover according to an embodiment of the disclosure.

FIG. 18 is an exploded perspective view illustrating a high and low pressure cover 150 according to an embodiment of the disclosure.

The high and low pressure cover 150 is disposed inside the main body 10 to divide the inside of the main body 10 into the low pressure section L and the high pressure section H, and may include the third discharge port 153 to communicate the low pressure section L and the high pressure section H.

The third discharge port 153 may connect the low pressure section L and the high pressure section H when the scroll compressor 1 does not operate, or until the scroll compressor 1 operates so that the pressure in the low pressure section L reaches a selected pressure.

When the pressure in the low pressure section L becomes the selected pressure so that the back pressure actuator 140 contacts the high and low pressure cover 150, the third discharge port 153 may be connected to the compression chamber P only through the fourth discharge port 143 of the back pressure actuator 140, the second discharge port 133 of the discharge guide 130, and the first discharge port 123 and the bypass flow paths b of the fixed scroll 120.

In addition, the high and low pressure cover 150 may include a second check valve 154 disposed in the third discharge port 153 to selectively open and close the third discharge port 153.

The second check valve 154 may include a second check valve body 154*a* configured to open and close the third discharge port 153, a second check valve guide 154*c* provided on the upper surface of the high and low pressure cover 150 to guide the vertical movement of the second check valve body 154*a*, a second check valve stopper 154*b* to limit the movement of the second check valve body 154*a*, and a second fastening member 154*d* to fix the second check valve stopper 154*b* to the second check valve guide 154*c*.

Therefore, the second check valve body 154*a* may move up and down along the second check valve guide 154*c*. The second check valve body 154*a* may be interfered by the high and low pressure cover 150 on the lower side, and may be restricted by the second check valve stopper 154*b* on the upper side.

Accordingly, when the pressure in the second discharge port 133 and the fourth discharge port 143 is greater than the pressure in the high pressure section H, the second check valve body 154*a* of the second check valve 154 may be moved upwards of the third discharge port 153 by the refrigerant in the second discharge port 133 and the fourth discharge port 143 to open the third discharge port 153.

In addition, when the pressure in the second discharge port 133 and the fourth discharge port 143 is smaller than the pressure in the high pressure section H, the second check valve body 154*a* may block the third discharge port 153 to prevent the refrigerant in the high pressure section H from flowing back to the second discharge port 133 and the fourth discharge port 143.

In other words, the second check valve 154 may allow the refrigerant in the low pressure section L to flow only in one direction to the high pressure section H.

Hereinafter, the movement of the refrigerant in the compression part 100 according to an embodiment of the disclosure will be described in detail with reference to FIG. 19.

FIG. 19 is a cross-sectional view taken along the line B-B in FIG. 1. Here, the line B-B may refer to a line crossing the centers of the first check valve 136 and the second check valve 154.

First, the refrigerant in the compression chamber P formed by the orbiting scroll 110 and the fixed scroll 120 may move from the low pressure section L to the high pressure section H through the first discharge port 123 positioned at the center of the fixed scroll 120, the second discharge port 133 of the discharge guide 130, and the third discharge port 153 of the high and low pressure cover 150.

Here, the refrigerant in the compression chamber P may move to the second discharge port 133 of the discharge guide 130 not only through the first discharge port 123 but also through the bypass flow paths b.

In addition, the first check valve 136 disposed between the first discharge port 123 of the fixed scroll 120 and the second discharge port 133 of the discharge guide 130 may selectively control the flow of the refrigerant. In addition, the second check valve 154 disposed at the third discharge port 153 of the high and low pressure cover 150 may selectively control the flow of refrigerant flowing into the high pressure section H.

On the other hand, the refrigerant in the compression chamber P may move to the back pressure chamber S formed between the discharge guide 130 and the back pressure actuator 140 through the back pressure flow path a consisting of the first back pressure flow path a-1 of the fixed scroll 120 and the second back pressure flow path a-2 of the discharge guide 130.

The refrigerant moved to the back pressure chamber S may move through the gap G formed between the first portion 130-1 of the discharge guide 130 and the back pressure actuator 140. In addition, when the sealing member 160 seals the gap G, the refrigerant moved to the back pressure chamber S may push the back pressure actuator 140 upward, thereby causing the back pressure actuator 140 to be in contact with the high and low pressure cover 150.

Hereinafter, the operation of the scroll compressor 1 according to an embodiment of the disclosure will be described in detail with reference to FIGS. 20A to 22B.

Figure 22A:
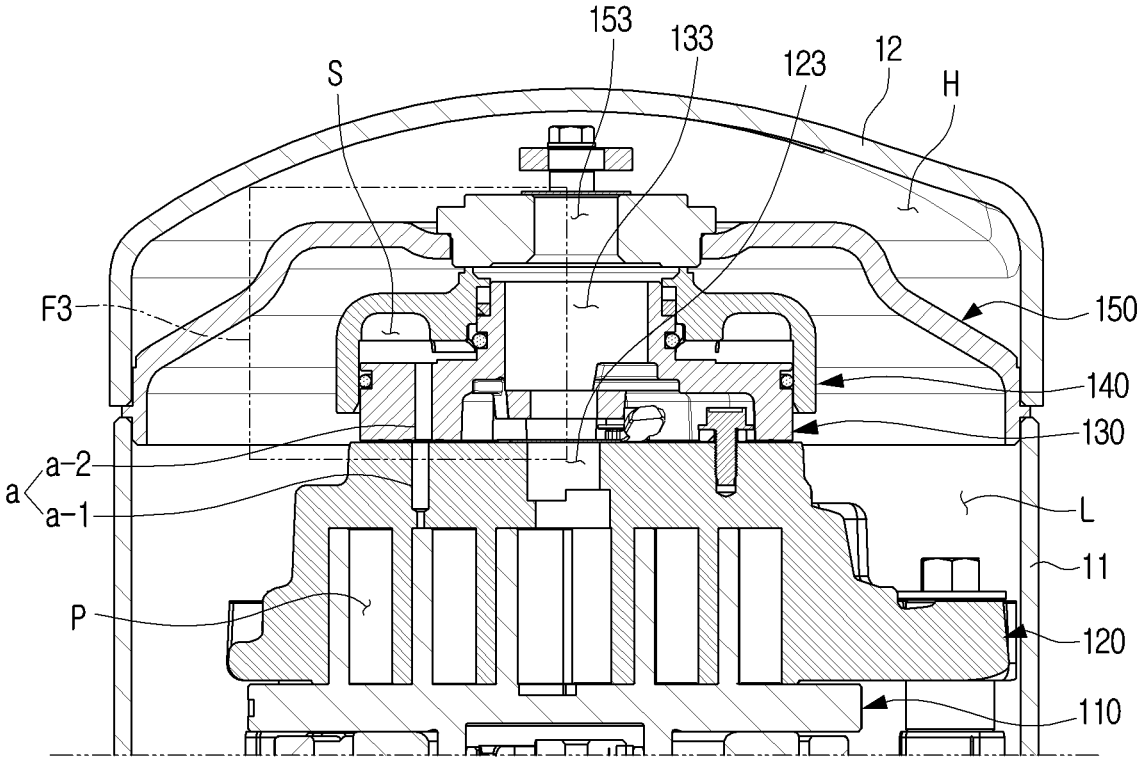
FIG. 22A is an enlarged view illustrating a third state according to driving of a scroll compressor according to an embodiment of the disclosure.
Figure 22B:
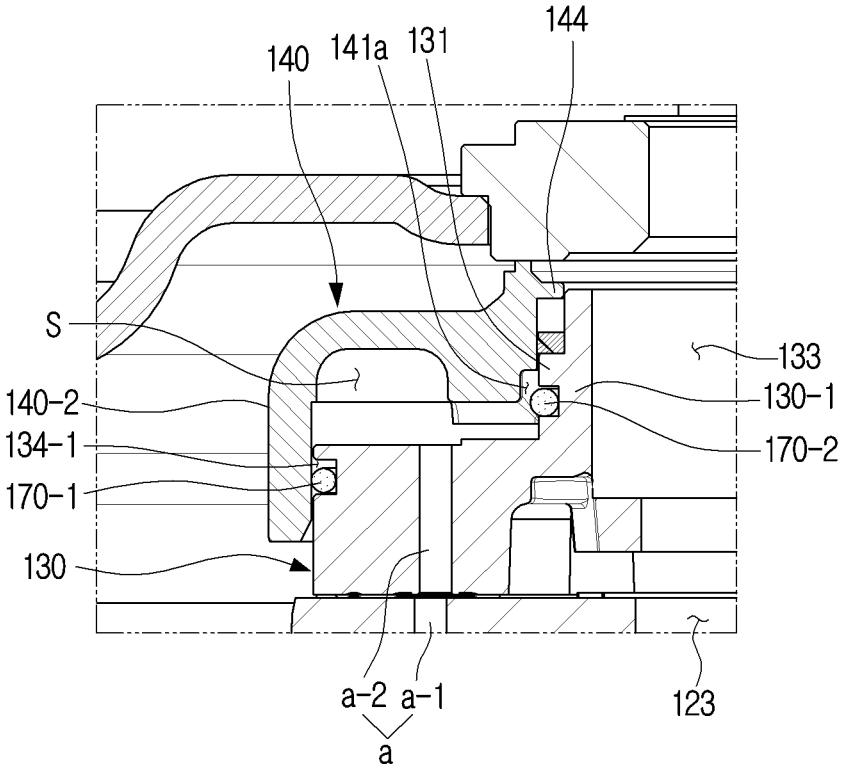
FIG. 22B is an enlarged view illustrating a region F3 of FIG. 22A.

FIG. 20A is an enlarged view illustrating a region C of FIG. 3 in a first state according to driving of a scroll compressor 1 according to an embodiment of the disclosure. FIG. 20B is an enlarged view illustrating a region F1 of FIG. 20A. FIG. 21A is an enlarged view illustrating a second state according to driving of a scroll compressor 1 according to an embodiment of the disclosure. FIG. 21B is an enlarged view illustrating a region F2 of FIG. 21A. FIG. 22A is an enlarged view illustrating a third state according to driving of a scroll compressor 1 according to an embodiment of the disclosure. FIG. 22B is an enlarged view illustrating a region F3 of FIG. 22A.

Here, the first state refers to a state before the scroll compressor 1 is operated, the second state refers to a state in which the sealing member 160 closes the gap G after the scroll compressor 1 is operated, and the third state refers to a state in which the scroll compressor 1 continues to operate and the back pressure actuator 140 contacts the high and low pressure cover 150.

First, as illustrated in FIGS. 20A and 20B, when the scroll compressor 1 operates, the orbiting scroll 110 may orbit and rotate relative to the fixed scroll 120.

The refrigerant flowing into the compression chamber P formed by the orbiting scroll 110 and the fixed scroll 120 may be compressed to increase pressure, and move to the back pressure chamber S through the back pressure flow path a.

At this time, the compressed refrigerant in the compression chamber P does not exceed the selected pressure of the first check valve 136 and the bypass valves 124, so it may not flow to the second discharge port 133.

However, if necessary, by adjusting the selected pressure of the first check valve 136 and the bypass valves 124, the compressed refrigerant in the compression chamber P may flow to the low pressure section L.

As illustrated in FIG. 20B, the refrigerant moved into the back pressure chamber S may move to the low pressure section L in the main body 10 through the refrigerant flow ports 141*a*, the gap G formed between the first portion 130-1 and the back pressure actuator 140, and the space formed between the first inclined surface 162-1*a* and the second inclined surface 162-2*a* of the sealing member 160.

For example, when the first pressure in the back pressure chamber S is greater than the second pressure in the second discharge port 133, the first inclined surface 162-1*a* and the second inclined surface 162-2*a* are spaced apart from each other, so that the refrigerant can flow therebetween.

In other words, the refrigerant may move due to the difference between the first pressure and the second pressure.

In detail, as illustrated in FIG. 20B, through the space between the first inclined surface 162-1*a* and the second inclined surface 162-2*a* of the sealing member 160 and the gap G between the discharge guide 130 and the back pressure actuator 140, the refrigerant in the back pressure chamber S may be discharged out of the back pressure chamber S along the discharge passage Y.

Here, the second pressure in the second discharge port 133 may be the same as the pressure in the low pressure section L. In addition, the refrigerant in the back pressure chamber S may move only through the gap G spaced apart by the second O-ring member 170-2, and may not move between the extension portion 140-2 of the back pressure actuator 140 and the second portion 130-2 of the discharge guide 130 due to the first O-ring member 170-1.

Accordingly, during the initial start-up of the scroll compressor 1, the refrigerant in the back pressure chamber S may pass through the sealing member 160 and move to the low pressure section L, so that the scroll compressor 1 operates without being affected by the initial pressure resistance.

In other words, the initial operating torque for filling the inside of the low pressure section L of the scroll compressor 1 with the selected pressure may be reduced.

In detail, considering that when the refrigerant in the back pressure chamber S cannot flow into the low pressure section L during the initial start-up, such as a scroll compressor according to the prior art, due to the pressure resistance caused by the refrigerant condensing in the compression chamber P and the back pressure chamber S, a lot of torque is required during the initial operation of the scroll compressor, the scroll compressor 1 according to the disclosure may reduce the initial operating torque through the sealing member 160 configured to allow the refrigerant in the back pressure chamber S to selectively flow therethrough.

Next, as illustrated in FIGS. 21A and 21B, as the scroll compressor 1 continuously operates, the pressure in the low pressure section L may be the same.

For example, the second pressure in the second discharge port 133, which is the pressure in the low pressure section L, may be the same as or greater than the first pressure in the back pressure chamber S.

Accordingly, the refrigerant in the back pressure chamber S no longer moves to the second discharge port 133 and the low pressure section L, and the sealing member 160 may seal the gap G between the discharge guide 130 and the back pressure actuator 140.

For example, when the first pressure in the back pressure chamber S is smaller than the second pressure in the second discharge port 133, the first inclined surface 162-1*a* and the second inclined surface 162-2*a* contact each other, thereby preventing the refrigerant from flowing therebetween.

In addition, the first contact surface 162-1*b* of the first cut portion 162-1 may contact the back pressure actuator 140, and the second contact surface 162-1*c* of the first cut portion 162-1 may contact the discharge guide 130.

Therefore, the back pressure chamber S and the low pressure section L are spatially separated from each other, so that the refrigerant cannot move therebetween.

Thereafter, as illustrated in FIGS. 22A and 22B, when the scroll compressor 1 is additionally operated, the pressure of the refrigerant in the back pressure chamber S is increased, and due to the pressure of the refrigerant in the back pressure chamber S, the back pressure actuator 140 is moved upward with respect to the discharge guide 130.

Accordingly, the back pressure actuator 140 is in contact with and connected to the high and low pressure cover 150. In detail, the fourth discharge port 143 of the back pressure actuator 140 is connected to the third discharge port 153 of the high and low pressure cover 150.

Therefore, the low pressure section L and the high pressure section H in the main body 10 are separated, and the refrigerant compressed in the compression chamber P moves to the high pressure section H through the second discharge port 133, the fourth discharge port 143, and the third discharge port 153, and then moves to the outside of the main body 10.

At this time, because the discharge guide 130 and the back pressure actuator 140 are separated from each other by the second O-ring member 170-2, when the back pressure actuator 140 moves, noise generated by contact with the discharge guide 130 may be reduced.

Therefore, the compression efficiency of the scroll compressor 1 may be improved, and the noise generated during operation of the scroll compressor 1 may be greatly reduced.

Hereinafter, a wave spring 180 according to a modified embodiment of the disclosure will be described with reference to FIGS. 23 and 24.

Figure 23:
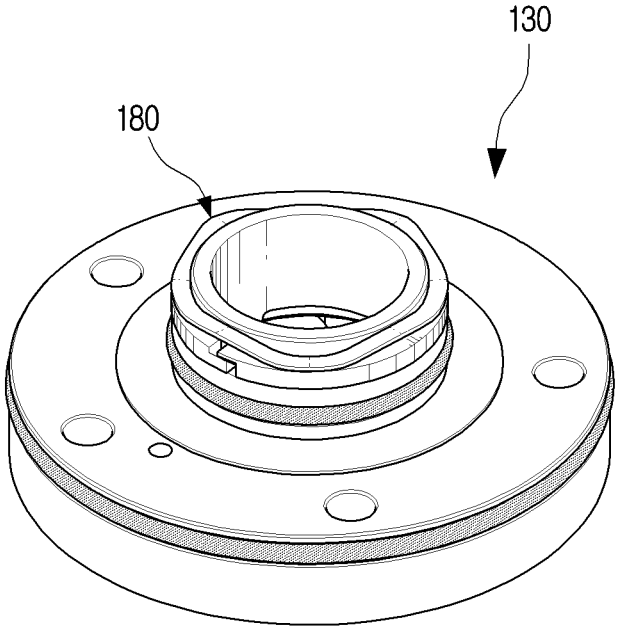
FIG. 23 is a perspective view illustrating a wave spring coupled to a discharge guide according to a modified embodiment of the disclosure.

FIG. 23 is a perspective view illustrating a wave spring 180 coupled to a discharge guide 130 according to a modified embodiment of the disclosure. FIG. 24 is an enlarged cross-sectional view illustrating a scroll compressor to which the wave spring 180 of FIG. 23 is coupled.

Here, the same reference numerals are used for the same members to omit overlapping descriptions. For example, because the discharge guide 130 has the same configuration as the above-described discharge guide 130, the overlapping description is omitted.

The wave spring 180 is disposed on the top of the sealing member 160 to press the sealing member 160 in the downward direction, and may have a ring shape.

Figure 24:
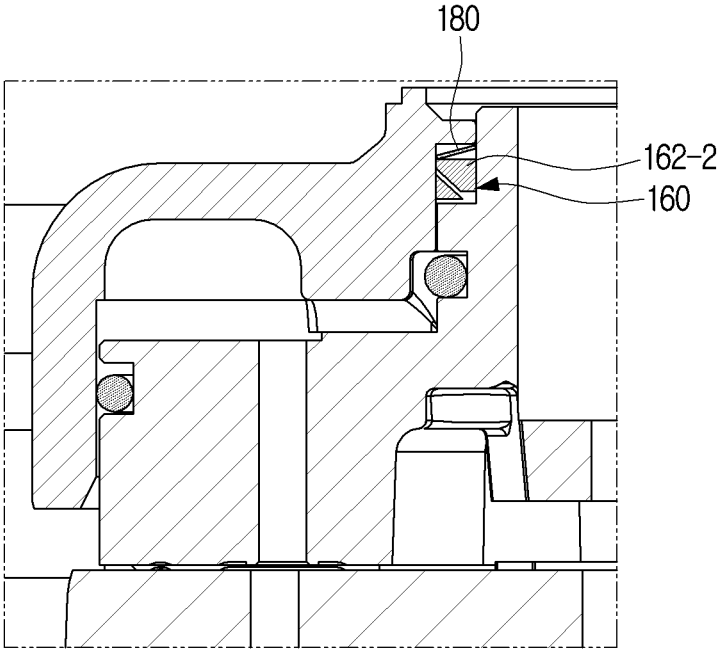
FIG. 24 is an enlarged cross-sectional view illustrating a scroll compressor to which the wave spring of FIG. 23 is coupled.

In detail, as illustrated in FIG. 24, the wave spring 180 continuously presses the second cut portion 162-2, so that the second pressure in the second discharge port 133 may be adjusted with respect to the first pressure of the refrigerant in the back pressure chamber S.

Accordingly, the wave spring 180 may improve the operating efficiency of the scroll compressor 1 by preventing the sealing member 160 from excessively flowing the refrigerant in the back pressure chamber S.

Hereinafter, a scroll compressor 1' according to another embodiment of the disclosure will be described in detail with reference to FIGS. 25 and 26.

Figure 25:
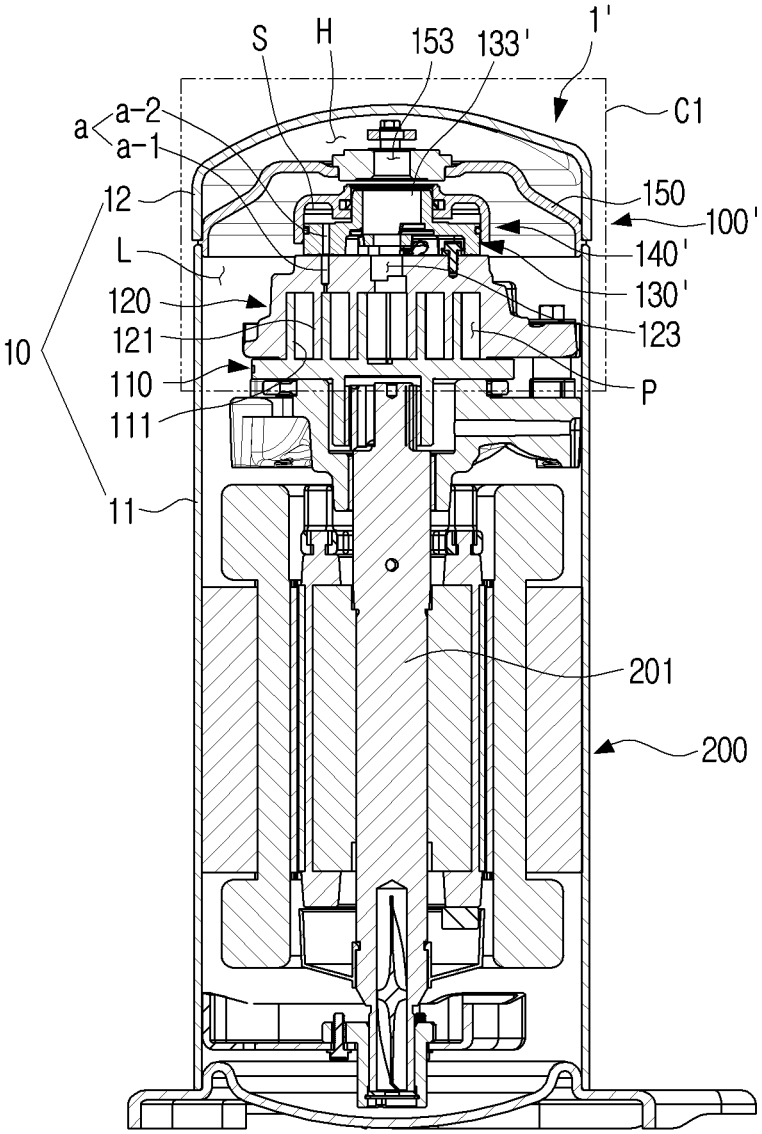
FIG. 25 is a cross-sectional view illustrating a scroll compressor according to an embodiment of the disclosure.

FIG. 25 is a cross-sectional view illustrating a scroll compressor 1' according to an embodiment of the disclosure. FIG. 26 is an enlarged view illustrating a region C1 of the scroll compressor 1' of FIG. 25.

Figure 26:
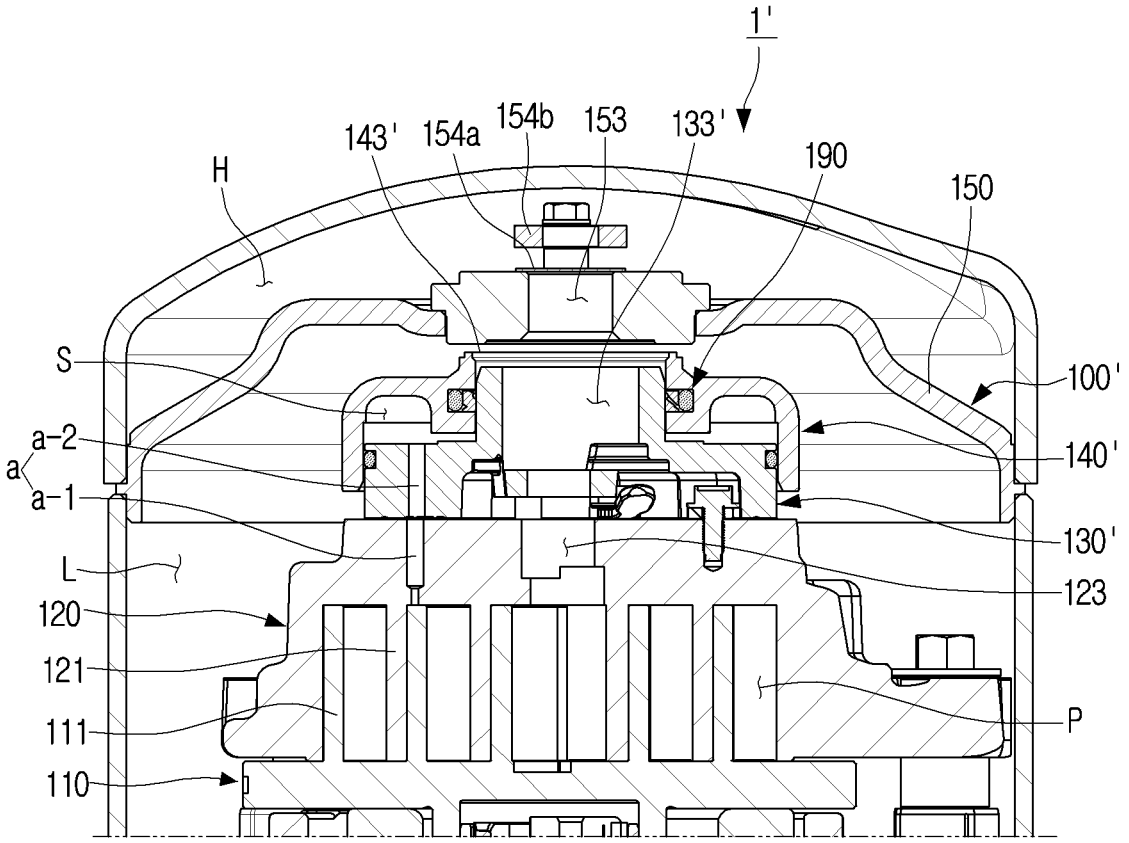
FIG. 26 is an enlarged view illustrating a region C1 of the scroll compressor of FIG. 25.

Referring to FIGS. 25 and 26, the scroll compressor 1' according to an embodiment of the disclosure may include a main body 10, a compression part 100', and a motor part 200.

The main body 10 forms the overall appearance of the scroll compressor 1', and may include a first main body 11 having a refrigerant inlet 13 into which the refrigerant flows and a second main body 12 having a refrigerant outlet 14.

In detail, the first main body 11 and the second main body 12 are coupled to form the main body 10, and the main body 10 is sealed except for the refrigerant inlet 13 and the refrigerant outlet 14. In other words, the refrigerant may pass through the main body 10 only through the refrigerant inlet 13 and the refrigerant outlet 14.

In addition, the inner space of the main body 10 may be partitioned by a high and low pressure cover 150 to form a low pressure section L and a high pressure section H. In detail, as illustrated in FIG. 25, the first main body 11 and the high and low pressure cover 150 may form the low pressure section L, and the second main body 12 and the high and low pressure cover 150 may form the high pressure section H.

Here, the low pressure section L and the high pressure section H refer to sections where a pressure difference occurs inside the main body 10 based on the high and low pressure cover 150 when the scroll compressor 1' operates. When the scroll compressor 1' does not operate, the pressure of the low pressure section L and the pressure of the high pressure section H may be the same.

Accordingly, the refrigerant may be introduced into the main body 10 through the refrigerant inlet 13, and may be compressed by the compression part 100' disposed inside the main body 10, so that the compressed refrigerant may be discharged to the outside of the main body 10 through the refrigerant outlet 14.

The compression part 100' may be disposed inside the main body 10 to compress the refrigerant. In other words, the compression part 100' is disposed in the low pressure section L inside the main body 10, and is formed to compress the refrigerant introduced into the main body 10. The detailed structure of the compression part 100' will be described later with reference to FIGS. 26 and 27.

The motor part 200 may be disposed inside the main body 10 and may be formed to be connected to compression part 100' to drive the compression part 100'.

In other words, the motor part 200 is disposed in the low pressure section L inside the main body 10 and may be connected to the compression part 100' through a motor shaft 201 to provide a driving force for compressing the refrigerant. In detail, the motor part 200 may be connected to an orbiting scroll 110 through the motor shaft 201 to rotate the orbiting scroll 110.

Hereinafter, a detailed structure of the compression part 100' will be described with reference to FIGS. 26 and 27.

Figure 27:
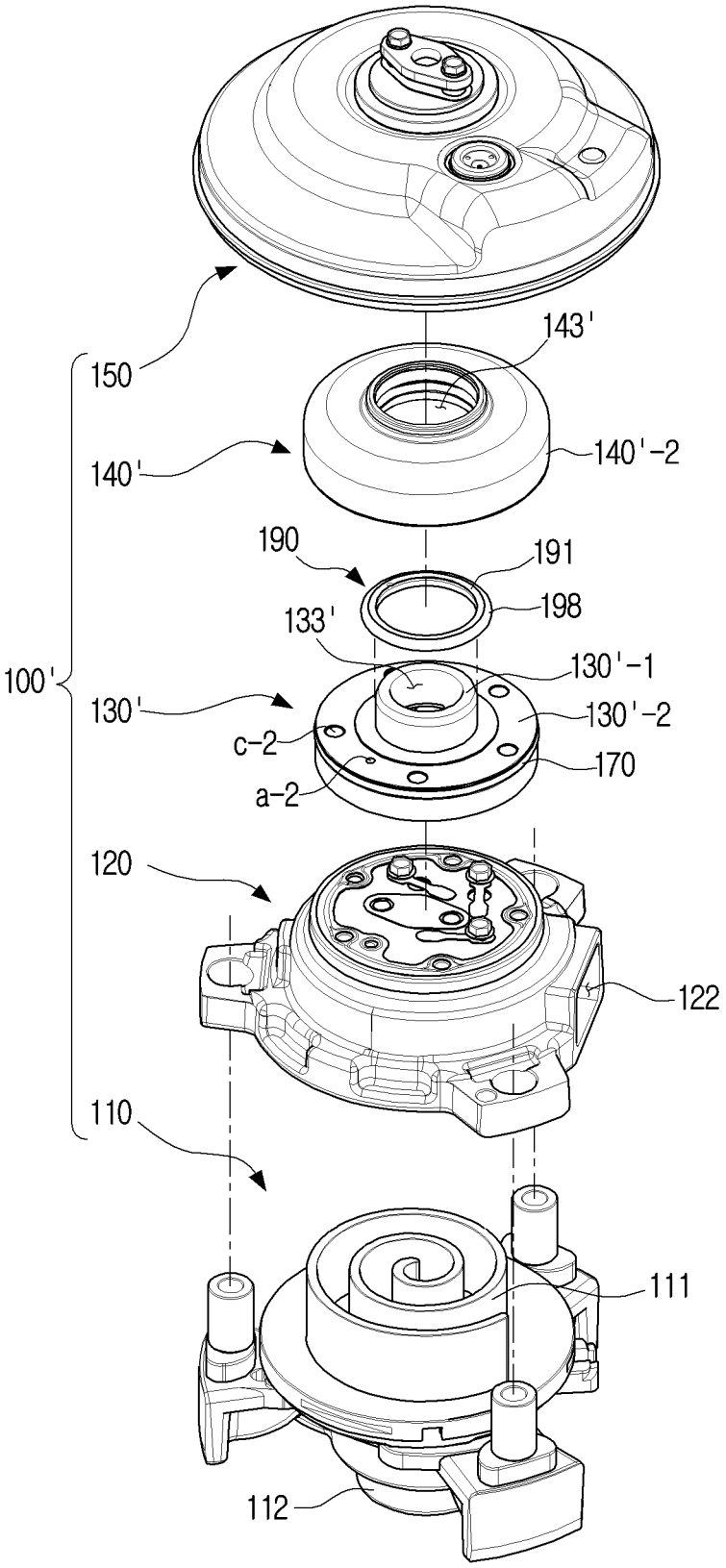
FIG. 27 is an exploded perspective view illustrating a compression part of the scroll compressor of FIG. 25.

FIG. 27 is an exploded perspective view illustrating a compression part 100' of the scroll compressor 1' of FIG. 25.

The compression part 100' of the scroll compressor 1' is disposed in the low pressure section L of the main body 10, and may include the orbiting scroll 110, a fixed scroll 120, a discharge guide 130', a back pressure actuator 140', and a high and low pressure cover 150.

The orbiting scroll 110 is connected to the motor part 200 and is formed to orbit relative to the fixed scroll 120 while engaging with the fixed scroll 120. The orbiting scroll 110 is supported by a fixing part 112 disposed inside the main body 10, and is connected to the motor shaft 201 of the motor part 200 to rotate in a selected direction.

The fixed scroll 120 is fixed to the main body 10 in the upper side of the orbiting scroll 110, and is engaged with the orbiting scroll 110 to form a compression chamber P.

The structures of the orbiting scroll 110 and the fixed scroll 120 are the same as that of the compression part 100 of the scroll compressor 1 according to the above-described embodiment, so detailed descriptions thereof are omitted.

The discharge guide 130' is disposed above the fixed scroll 120, and is configured to guide the refrigerant compressed in the compression chamber P to the high pressure section H. The discharge guide 130' is fixed to the fixed scroll 120.

Hereinafter, the structure of the discharge guide 130' will be described in detail with reference to FIGS. 26 and 28.

Figure 28:
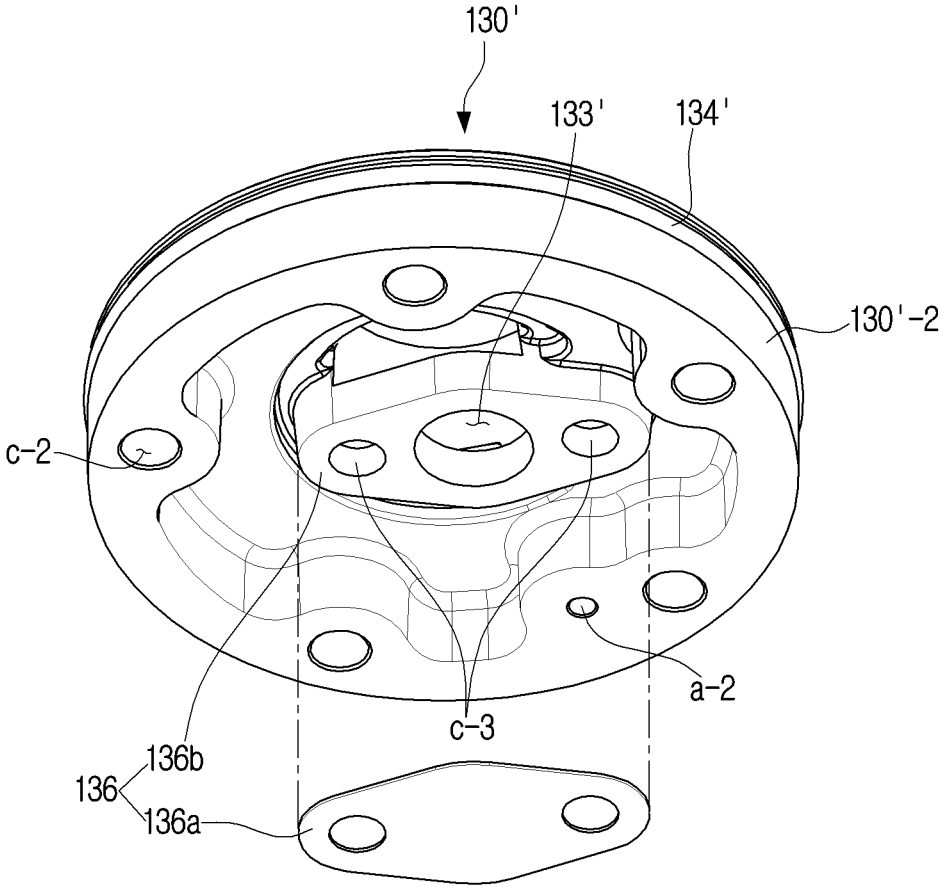
FIG. 28 is a bottom perspective view illustrating a discharge guide according to an embodiment of the disclosure.

FIG. 28 is a bottom perspective view illustrating a discharge guide 130' according to an embodiment of the disclosure.

Referring to FIGS. 26 and 28, the discharge guide 130' may be disposed between the fixed scroll 120 and the high and low pressure cover 150, and is formed to guide the refrigerant, which is compressed by the orbiting scroll 110 and the fixed scroll 120 and then discharged from the fixed scroll 120, toward the high and low pressure cover 150.

In detail, the discharge guide 130' may include the second discharge port 133' connected to the first discharge port 123 of the fixed scroll 120 to guide the compressed refrigerant in the compression chamber P to the high and low pressure cover 150, a first portion 130'-1 forming the second discharge port 133', and a second portion 130'-2 connected to the first portion 130'-1 and having a diameter larger than the diameter of the first portion 130'-1.

The second discharge port 133' is a hole penetrating the discharge guide 130', and the compressed refrigerant may flow through the second discharge port 133'. The second discharge port 133' is formed from the second portion 130'-2 to the first portion 130'-1, and the second discharge port 133' may have a large diameter at the second portion 130'-2 and a diameter smaller than that of the second portion 130'-2 at the first portion 130'-1.

The second discharge port 133' may be in fluid communication with the first discharge port 123 and the bypass flow paths b of the fixed scroll 120, and guide the refrigerant compressed to the selected pressure by the fixed scroll 120 and the orbiting scroll 110 to a third discharge port 153 of the high and low pressure cover 150.

In other words, the second discharge port 133' may be connected to the first discharge port 123 to guide the compressed refrigerant in the compression chamber P to the high and low pressure cover 150.

As illustrated in FIG. 27, the first portion 130'-1 of the discharge guide 130' is a portion in which the second discharge port 133' is narrowed, and may be formed in a hollow cylindrical shape.

The second portion 130'-2 has a hollow cylindrical shape with a larger diameter than the first portion 130'-1, and an O-ring accommodating portion 134' in which an O-ring member 170 is accommodated may be formed in the outer circumferential surface of the second portion 130'-2.

In addition, the second portion 130'-2 may be provided with a second back pressure flow path a-2 spaced apart by a selected distance from the second discharge port 133' and connected to the first back pressure flow path a-1 of the fixed scroll 120.

In detail, the discharge guide 130' may include the second back pressure flow path a-2 which is spaced apart from the second discharge port 133 and communicates between the first back pressure flow path a-1 and the back pressure chamber S.

Accordingly, when the second portion 130'-2 of the discharge guide 130' is coupled to the fixed scroll 120 through a plurality of second coupling holes C-2 and the plurality of first coupling holes C-1 of the fixed scroll 120, the first back pressure flow path a-1 and the second back pressure flow path a-2 forms a single back pressure flow path a so that the space of the fixed scroll 120 and the back pressure chamber S may be in fluid communication with each other.

In addition, the first portion 130'-1 of the discharge guide 130' is inserted into a fourth discharge port 143' of the back pressure actuator 140', and the second portion 130'-2 may be received inside an extension portion 140'-2 of the back pressure actuator 140'. Accordingly, the discharge guide 130' may be accommodated in an accommodation space 142' of the back pressure actuator 140' to be connected to back pressure actuator 140'.

Referring to FIG. 27 again, the discharge guide 130 may include the O-ring member 170 disposed along the outer circumferential surface of the second portion 130'-2 and sealing the gap between the back pressure actuator 140' and the second portion 130'-2.

In detail, as illustrated in FIG. 26, the O-ring member 170 is disposed between the second portion 130'-2 of the discharge guide 130' and the extension portion 140'-2 of the back pressure actuator 140', thereby sealing the back pressure chamber S.

The O-ring member 170 is a packing material of an annular shape, and may be made of synthetic rubber, fluorine resin, and the like. The O-ring member 170 may be fitted to the O-ring accommodating portion 134' of the second portion 130'-2 of the discharge guide 130'.

In addition, the discharge guide 130' may include a first check valve 136 disposed at the bottom of the second discharge port 133' of the discharge guide 130' and configured to selectively open and close the first discharge port 123 of the fixed scroll 120.

In detail, the first check valve 136 may include a first check valve body **136*a* configured to open and close the first discharge port 123, a first check valve guide 137 (see FIG. 34) disposed in a plurality of third coupling holes C-3 to guide the vertical movement of the first check valve body 136*a*, and a first check valve stopper 136*b* configured to limit the movement of the first check valve body 136*a***.

Therefore, the first check valve body **136*a* may move up and down along the first check valve guide 137. The movement of the first check valve body 136*a* may be limited by the fixed scroll 120 on the lower side, and may be limited by the first check valve stopper 136*b* formed integrally with the discharge guide 130'** on the upper side.

Accordingly, the first check valve 136 may open and close the first discharge port 123 of the fixed scroll 120. For example, when the pressure of the first discharge port 123 is greater than the pressure of the second discharge port 133' of the discharge guide 130', the first check valve body **136*a* may be moved upward by the refrigerant in the first discharge port 123, thereby opening the first discharge port 123**.

In addition, when the pressure in the first discharge port 123 of the fixed scroll 120 is smaller than the pressure in the second discharge port 133' of the discharge guide 130', the first check valve body **136*a* may be positioned on the upper surface of the fixed scroll 120 to close the first discharge port 123. Therefore, the first check valve 136 may prevent the refrigerant in the second discharge port 133' from flowing back to the first discharge port 123**.

The first check valve 136 may selectively communicate the second discharge port 133' of the discharge guide 130' with the first discharge port 123 of the fixed scroll 120, thereby improving the compression efficiency of the scroll compressor 1' through a simple structure.

Hereinafter, the structure of the back pressure actuator 140' according to an embodiment of the disclosure will be described in detail with reference to FIGS. 26, 27, 29, and 30.

Figure 29:
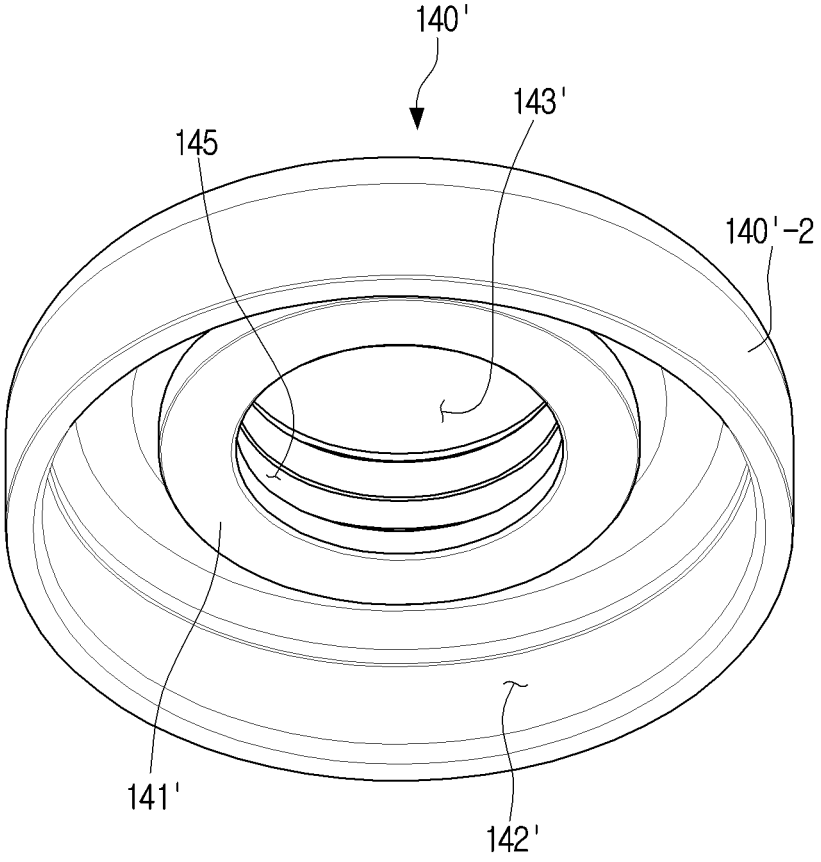
FIG. 29 is a bottom perspective view illustrating a back pressure actuator according to an embodiment of the disclosure.
Figure 30:
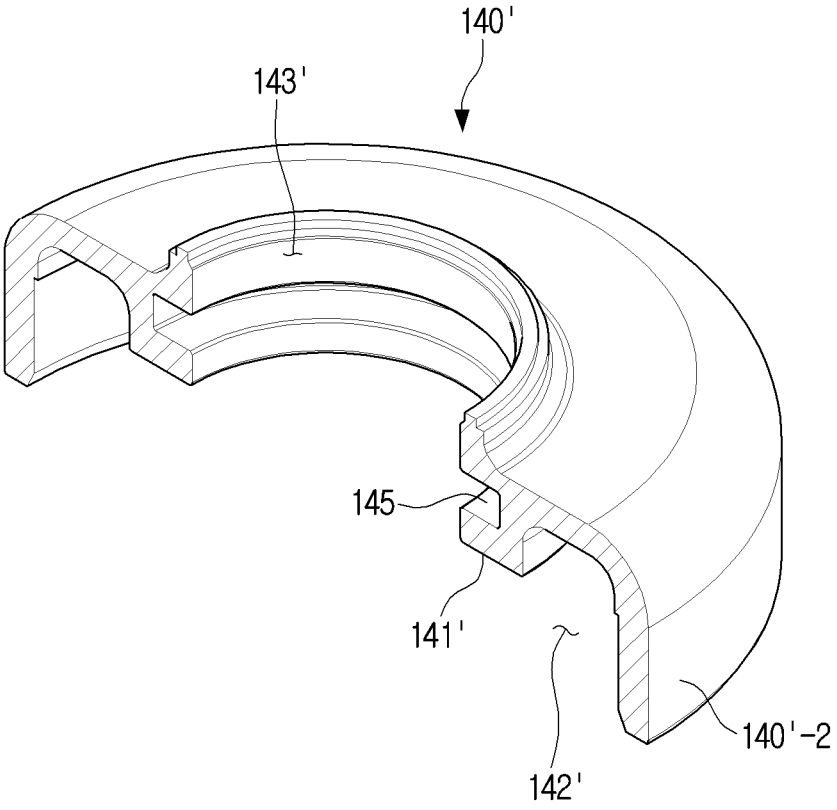
FIG. 30 is a cross-sectional perspective view illustrating the back pressure actuator of FIG. 29.

FIG. 29 is a bottom perspective view illustrating a back pressure actuator 140' according to an embodiment of the disclosure. FIG. 30 is a cross-sectional perspective view illustrating the back pressure actuator 140' of FIG. 29.

Referring to FIGS. 26, 27, 29, and 30, the back pressure actuator 140' is disposed to surround the upper and outer circumferential surfaces of the discharge guide 130' to form the back pressure chamber S together with the discharge guide 130'. In addition, the back pressure actuator 140' may move upward and downward with respect to the discharge guide 130' to selectively connect the second discharge port 133' and the high pressure section H.

The back pressure actuator 140' may include the accommodation space 142' into which the discharge guide 130' is inserted and which is configured to cover the first portion 130'-1 and the second portion 130'-2 of the discharge guide 130', a protrusion 141' which is formed in the accommodation space 142' and selectively contacts the second portion 130-2 of the discharge guide 130', the fourth discharge port 143' connected to the second discharge port 133' of the discharge guide 130', and a sealing accommodating groove 145 formed in the inner surface of the fourth discharge port 143' to accommodate a sealing member 190.

The back pressure actuator 140' may cover the upper surface and a portion of the side surface of the discharge guide 130', and may be coupled to the discharge guide 130' so that the back pressure actuator 140' is able to slide in the vertical direction relative to the discharge guide 130'.

In detail, the first portion 130'-1 of the discharge guide 130' may be inserted into the fourth discharge port 143' of the back pressure actuator 140'. In addition, the extension portion 140'-2 of the back pressure actuator 140' forms the accommodation space 142' and may be coupled to the second portion 130'-2 of the discharge guide 130' through the O-ring member 170.

When the back pressure actuator 140' and the discharge guide 130' are coupled to each other, the back pressure chamber S is formed between the back pressure actuator 140' and the discharge guide 130'. In detail, the upper space of the accommodation space 142' of the back pressure actuator 140' blocked by the second portion 130'-2 of the discharge guide 130' may form the back pressure chamber S.

The refrigerant in the back pressure chamber S formed by the back pressure actuator 140' and the discharge guide 130' may flow through the gap G between the first portion 130'-1 of the discharge guide 130' and the fourth discharge port 143' of the back pressure actuator 140'.

At this time, the gap G between the first portion 130'-1 of the discharge guide 130' and the back pressure actuator 140' may be maintained by the sealing member 190 accommodated in the sealing accommodating groove 145. Therefore, the outer circumferential surface of the first portion 130-1 of the discharge guide 130' does not directly contact the inner surface of the fourth discharge port 143' of the back pressure actuator 140'.

In detail, the sealing member 190 may separate the back pressure actuator 140' from the first portion 130'-1 of the discharge guide 130'. Accordingly, when the back pressure actuator 140' moves relative to the discharge guide 130' as the scroll compressor 1 operates, the noise generated by the back pressure actuator 140' contacting the discharge guide 130' may be prevented.

Therefore, the back pressure actuator 140' may improve the compression efficiency of the scroll compressor 1' and increase the assembly convenience, and at the same time, greatly reduce the noise generated during operation of the scroll compressor 1'.

The refrigerant in the back pressure chamber S may flow to the fourth discharge port 143' through the gap G between the discharge guide 130' and the back pressure actuator 140', but cannot flow between the extension portion 140'-2 of the back pressure actuator 140' and the second portion 130'-2 of the discharge guide 130' sealed by the O-ring member 170.

The extension portion 140'-2 may be extended to cover a portion of the side surface of the second portion 130'-2 of the discharge guide 130' even when the back pressure actuator 140' moves upwards with respect to the discharge guide 130' and contacts the high and low pressure cover 150.

However, the extension portion 140'-2 extends to such an extent that the extension portion 140'-2 covers only a portion of the side surface of the second portion 130'-2 of the discharge guide 130' and does not cover the fixed scroll 120.

The discharge guide 130' is inserted into the accommodation space 142' of the back pressure actuator 140' so that the back pressure actuator 140' covers the upper surface and a portion of the side surface of the discharge guide 130'. Thus, the back pressure actuator 140' forms the back pressure chamber S together with the discharge guide 130'. In addition, the back pressure actuator 140' may be coupled to the discharge guide 130' to move up and down relative to the discharge guide 130' so that the back pressure actuator 140' selectively contacts the high and low pressure cover 150.

In other words, when the scroll compressor 1' operates, the back pressure actuator 140' may be moved by the pressure in the back pressure chamber S to communicate the third discharge port 153 of the high and low pressure cover 150 and the second discharge port 133' of the discharge guide 130'. When the scroll compressor 1' is stopped, the back pressure actuator 140' may be spaced apart from the high and low pressure cover 150.

Accordingly, the compression efficiency of the scroll compressor 1' may be improved, and at the same time, the production efficiency of the scroll compressor 1' may be improved due to the convenience of assembling the compression part 100'. In other words, by inserting the discharge guide 130' into the accommodation space 142' of the back pressure actuator 140', the back pressure actuator 140' may slide up and down with respect to the discharge guide 130' while forming the back pressure chamber S and the gap G.

Hereinafter, a detailed structure of the sealing member 190 according to an embodiment of the disclosure will be described with reference to FIGS. 31 to 33.

Figure 31:
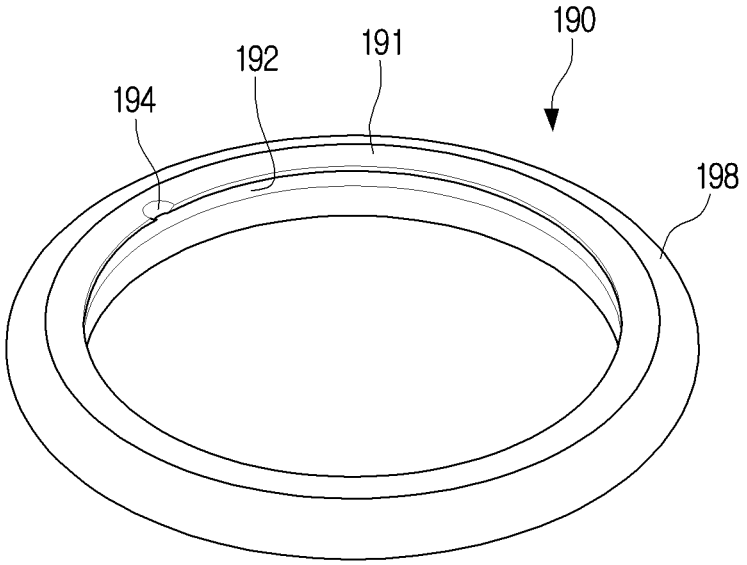
FIG. 31 is a perspective view illustrating a sealing member according to an embodiment of the disclosure.

FIG. 31 is a perspective view illustrating a sealing member 190 according to an embodiment of the disclosure. FIG. 32 is a cross-sectional view illustrating the sealing member 190 of FIG. 31. FIG. 33 is an exploded perspective view illustrating the sealing member 190 of FIG. 31.

The sealing member 190 is disposed between the discharge guide 130' and the back pressure actuator 140', and allows the refrigerant in the back pressure chamber S to selectively flow toward the second discharge port 133'.

In detail, the sealing member 190 is formed in a ring shape, and is disposed in the sealing accommodating groove 145 formed in the inner surface of the fourth discharge port 143' of the back pressure actuator 140'. The inner surface of the sealing member 190 is formed to contact the outer circumferential surface of the first portion 130'-1 of the discharge guide 130'.

The sealing member 190 may include a Teflon seal 191 and an O-ring 198 disposed on the outer circumferential surface of the Teflon seal 191.

The Teflon seal 191 is formed in a ring shape, and may include a refrigerant groove 192 formed along the inner circumferential surface thereof, a connecting hole 193 communicating the refrigerant groove 192 with the outer circumferential surface thereof, and an outlet 194 formed on the upper surface thereof and connected to the refrigerant groove 192.

The refrigerant groove 192 may be formed along the entire inner circumferential surface of the Teflon seal 191. The refrigerant groove 192 may be formed as a groove having a semicircular cross-section.

An inlet groove 195 connected to the connecting hole 193 may be provided in the outer circumferential surface of the Teflon seal 191. The inlet groove 195 may be formed along the outer circumferential surface of the Teflon seal 191.

For example, the inlet groove 195 may be formed along the entire outer circumferential surface of the Teflon seal 191. The inlet groove 195 may be formed as a groove having a triangular cross section. The inlet groove 195 may be formed in the lower portion of the Teflon seal 191 below the refrigerant groove 192. For example, the inlet groove 195 may be provided adjacent to the bottom of the Teflon seal 191.

Therefore, the connecting hole 193 may be formed as a circular tunnel inclined upward from the inlet groove 195.

The outlet 194 is formed on the upper surface of the Teflon seal 191, and may be formed in a conical shape an apex portion of which is connected to the refrigerant groove 192.

Therefore, the refrigerant may be introduced into the refrigerant groove 192 through the inlet groove 195 and the connecting hole 193. The refrigerant introduced into the refrigerant groove 192 may be discharged to the outside of the Teflon seal 191 through the outlet 194.

The above-described connecting hole 193, the refrigerant groove 192, and the outlet 194 form a refrigerant flow path through which the refrigerant flows. Therefore, the refrigerant may flow through the Teflon seal 191, that is, the sealing member 190.

The height of the Teflon seal 191 may be formed smaller than the width of the sealing accommodating groove 145 of the back pressure actuator 140'. Therefore, when the pressure below the sealing member 190 is higher than above the sealing member 190, the Teflon seal 191 contacts the upper surface **145*a* of the sealing accommodating groove 145, so that a gap through which the refrigerant flows may be formed between the lower surface of the Teflon seal 191 and the lower surface 145*a* of the sealing accommodating groove 145. Accordingly, the refrigerant below the sealing member 190 may flow to the upper side of the sealing member 190 through the Teflon seal 191**.

On the contrary, when the pressure above the sealing member 190 is higher than below the sealing member 190, the Teflon seal 191 contacts the lower surface **145*a* of the sealing accommodating groove 145, so that there is no gap through which the refrigerant flows between the lower surface of the Teflon seal 191 and the lower surface 145*a* of the sealing accommodating groove 145. Therefore, the refrigerant below the sealing member 190 may not flow to the upper side of the sealing member 190 through the Teflon seal 191**.

Figure 32:
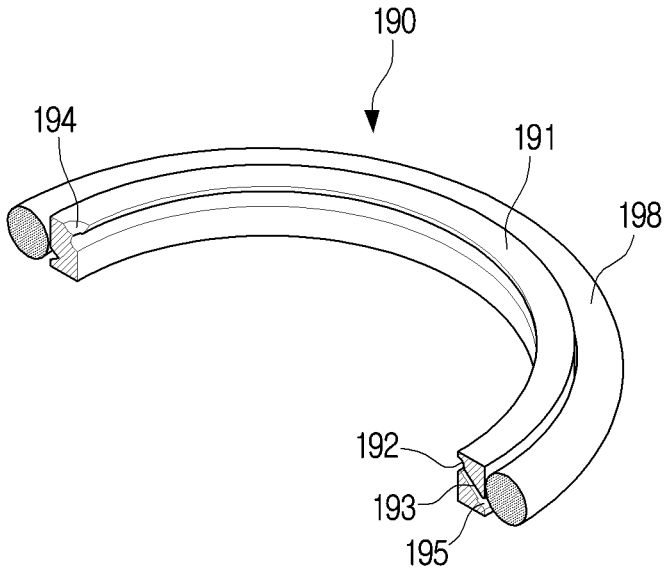
FIG. 32 is a cross-sectional perspective view illustrating the sealing member of FIG. 31.
Figure 33:
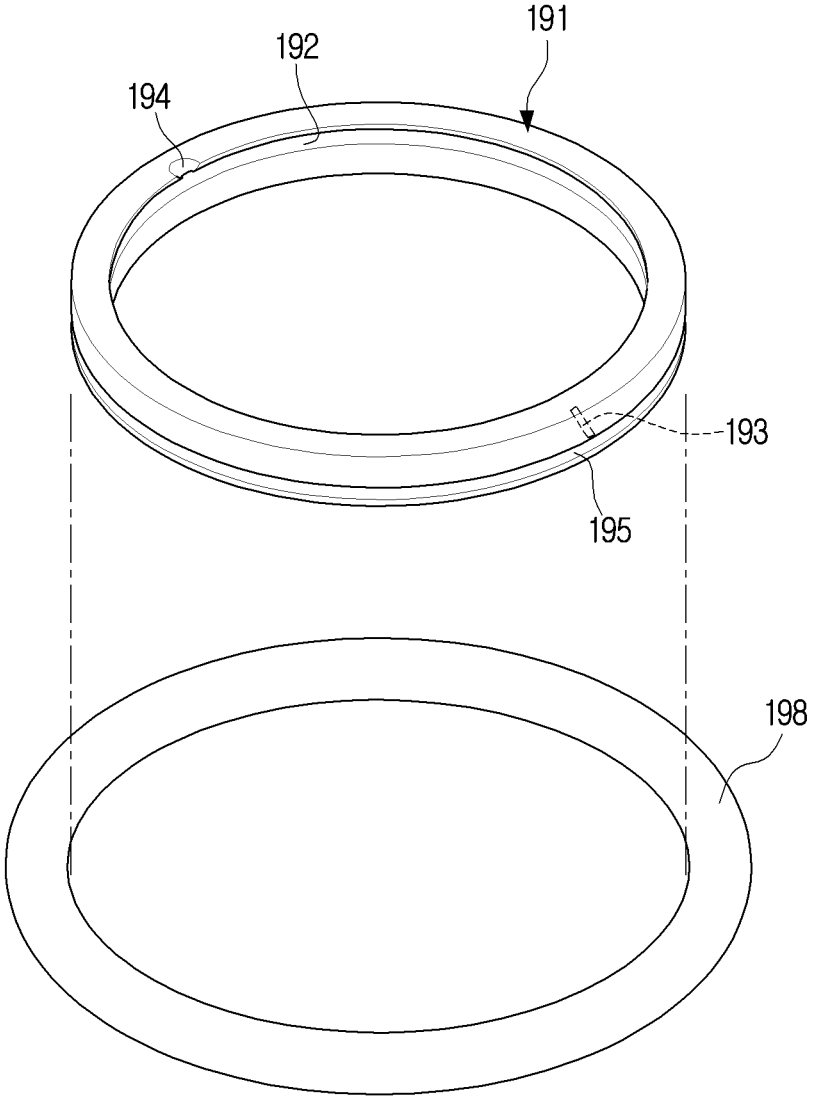
FIG. 33 is an exploded perspective view illustrating the sealing member of FIG. 31.

The Teflon seal 191 according to an embodiment as illustrated in FIGS. 31 and 32 includes one outlet 194 and one connecting hole 193; however, the disclosure is not limited thereto. If necessary, the Teflon seal 191 may have two or more outlets 194 and connecting holes 193.

The Teflon seal 191 is formed of Teflon having less friction than rubber, which is a material of the O-ring 198. Therefore, the discharge guide 130' contacting the Teflon seal 191 may move smoothly with respect to the Teflon seal 191.

The O-ring 198 is formed in a ring shape, and is coupled to the outer circumferential surface of the Teflon seal 191. The O-ring 198 elastically supports the Teflon seal 191 so that the inner circumferential surface of the Teflon seal 191 contacts the outer circumferential surface of the first portion 130'-1 of the discharge guide 130'. When the inner circumferential surface of the Teflon seal 191 contacts the first portion 130-1 of the discharge guide 130', the refrigerant does not leak between the inner circumferential surface of the Teflon seal 191 and the first portion 130'-1 of the discharge guide 130'.

Therefore, when the sealing member 190 is disposed in the sealing accommodating groove 145 of the back pressure actuator 140' and the discharge guide 130' is disposed in the back pressure actuator 140', the first portion 130-1 of the discharge guide 130' contacts the inner circumferential surface of the Teflon seal 191. At this time, the outer circumferential surface of the first portion 130'-1 of the discharge guide 130' does not contact the inner circumferential surface of the fourth discharge port 143' of the back pressure actuator 140', and there is a selected gap G therebetween.

In other words, because the fourth discharge port 143' of the back pressure actuator 140' is spaced apart from the first portion 130-1 of the discharge guide 130' by the Teflon seal 191, the back pressure actuator 140' may slide smoothly with respect to the discharge guide 130'.

In addition, the O-ring 198 functions to selectively block the inlet groove 195 of the Teflon seal 191. For example, when a high pressure is applied to the lower side of the sealing member 190, the O-ring 198 is positioned on the upper portion of the Teflon seal 191, thereby opening the inlet groove 195. Thus, the refrigerant below the sealing member 190 may flow to the upper side of the sealing member 190 through the connecting hole 193, the refrigerant groove 192, and the outlet 194. In other words, the upper side and the lower side of the sealing member 190 may be in fluid communication with each other.

On the other hand, when a high pressure is applied to the upper side of the sealing member 190, the O-ring 198 is positioned in the lower portion of the sealing member 190, thereby blocking the inlet groove 195. Thus, the refrigerant below the sealing member 190 does not flow into the connecting hole 193. Therefore, the upper side and the lower side of the sealing member 190 may be not in fluid communication with each other.

The high and low pressure cover 150 is disposed inside the main body 10 to divide the inside of the main body 10 into the low pressure section L and the high pressure section H, and may include the third discharge port 153 connecting the low pressure section L and the high pressure section H.

The third discharge port 153 may communicate the low pressure section L with the high pressure section H when the scroll compressor 1' does not operate or until the scroll compressor 1' operates so that the pressure in the low pressure section L reaches the selected pressure.

When the pressure in the low pressure section L becomes the selected pressure so that the back pressure actuator 140' contacts the high and low pressure cover 150, the third discharge port 153 may be in fluid communication with the compression chamber P only through the fourth discharge port 143' of the back pressure actuator 140', the second discharge port 133' of the discharge guide 130', and the first discharge port 123 and the bypass flow paths b of the fixed scroll 120.

In addition, the high and low pressure cover 150 may include a second check valve 154 disposed in the third discharge port 153 to selectively open and close the third discharge port 153. The second check valve 154 is the same as the second check valve 154 of the scroll compressor 1 as illustrated in FIG. 18; therefore, the second check valve 154 will be described below with reference to FIG. 18.

The second check valve 154 may include a second check valve body 154*a* configured to open and close the third discharge port 153, a second check valve guide 154*c* provided on the upper surface of the high and low pressure cover 150 to guide the vertical movement of the second check valve body 154*a*, a second check valve stopper 154*b* configured to limit the movement of the second check valve body 154*a*, and a second fastening member 154*d* to fix the second check valve stopper 154*b* to the second check valve guide 154*c*.

Therefore, the second check valve body 154*a* may move up and down along the second check valve guide 154*c*. The second check valve body 154*a* may be interfered by the high and low pressure cover 150 on the lower side and interfered by the second check valve stopper 154*b* on the upper side, so that the vertical movement of the second check valve body 154*a* may be restricted.

When the pressure of the refrigerant in the second discharge port 133' and the fourth discharge port 143' is greater than the pressure in the high pressure section H, the second check valve body 154*a* of the second check valve 154 may be moved upwards of the third discharge port 153 by the refrigerant in the second discharge port 133' and the fourth discharge port 143' to open the third discharge port 153.

On the other hand, when the pressure of the refrigerant in the second discharge port 133' and the fourth discharge port 143' is smaller than the pressure in the high pressure section H, the second check valve body 154*a* may block the third discharge port 153 to prevent the refrigerant in the high pressure section H from flowing back to the second discharge port 133' and the fourth discharge port 143'.

In other words, the second check valve 154 of the high and low pressure cover 150 may allow the refrigerant in the low pressure section L to flow only in one direction to the high pressure section H.

Hereinafter, the movement of the refrigerant in the compression part 100' of the scroll compressor 1' according to an embodiment of the disclosure will be described in detail with reference to FIG. 34.

Figure 34:
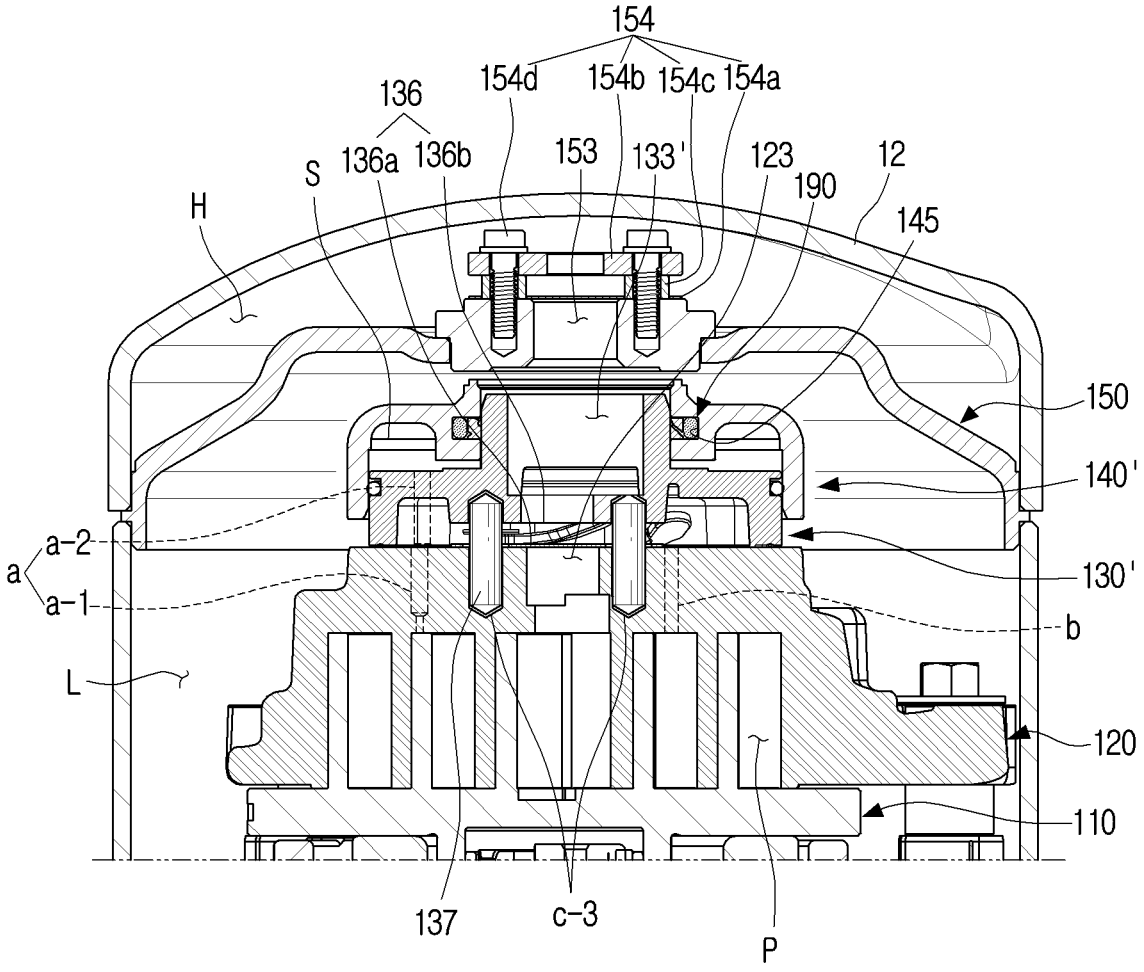
FIG. 34 is a cross-sectional view taken along the centers of a first check valve and a second check valve of a compression part of the scroll compressor of FIG. 25.

FIG. 34 is a cross-sectional view taken along the centers of a first check valve 136 and a second check valve 154 of a compression part 100' of the scroll compressor 1' of FIG. 25.

First, the refrigerant may be compressed in the compression chamber P formed by the orbiting scroll 110 and the fixed scroll 120, and then may move from the low pressure section L to the high pressure section H through the first discharge port 123 positioned at the center of the fixed scroll 120, the second discharge port 133' of the discharge guide 130', and the third discharge port 153 of the high and low pressure cover 150.

At this time, the refrigerant in the compression chamber P may flow to the second discharge port 133' of the discharge guide 130' not only through the first discharge port 123 but also through the bypass flow paths b.

In addition, the first check valve 136 is disposed between the first discharge port 123 of the fixed scroll 120 and the second discharge port 133' of the discharge guide 130' to selectively control the flow of the refrigerant. In addition, the second check valve 154 is disposed at the third discharge port 153 of the high and low pressure cover 150 so that the refrigerant may be selectively introduced into the high pressure section H.

On the other hand, the refrigerant in the compression chamber P may move to the back pressure chamber S formed between the discharge guide 130' and the back pressure actuator 140' through the back pressure flow path a consisting of a first back pressure flow path a-1 of the fixed scroll 120 and a second back pressure flow path a-2 of the discharge guide 130'.

The refrigerant moved to the back pressure chamber S may move to the lower side of the sealing member 190 through the gap G formed between the first portion 130'-1 of the discharge guide 130' and the back pressure actuator 140'. Thus, the sealing member 190 is raised by the refrigerant, so that the back pressure actuator 140' in which the sealing member 190 is disposed is raised to come into contact with the high and low pressure cover 150. In other words, the refrigerant moved to the back pressure chamber S may push the back pressure actuator 140' upward, thereby causing the back pressure actuator 140' to contact the high and low pressure cover 150.

Hereinafter, the operation of the scroll compressor 1' according to an embodiment of the disclosure will be described in detail with reference to FIGS. 35A to 37B.

Figure 35A:
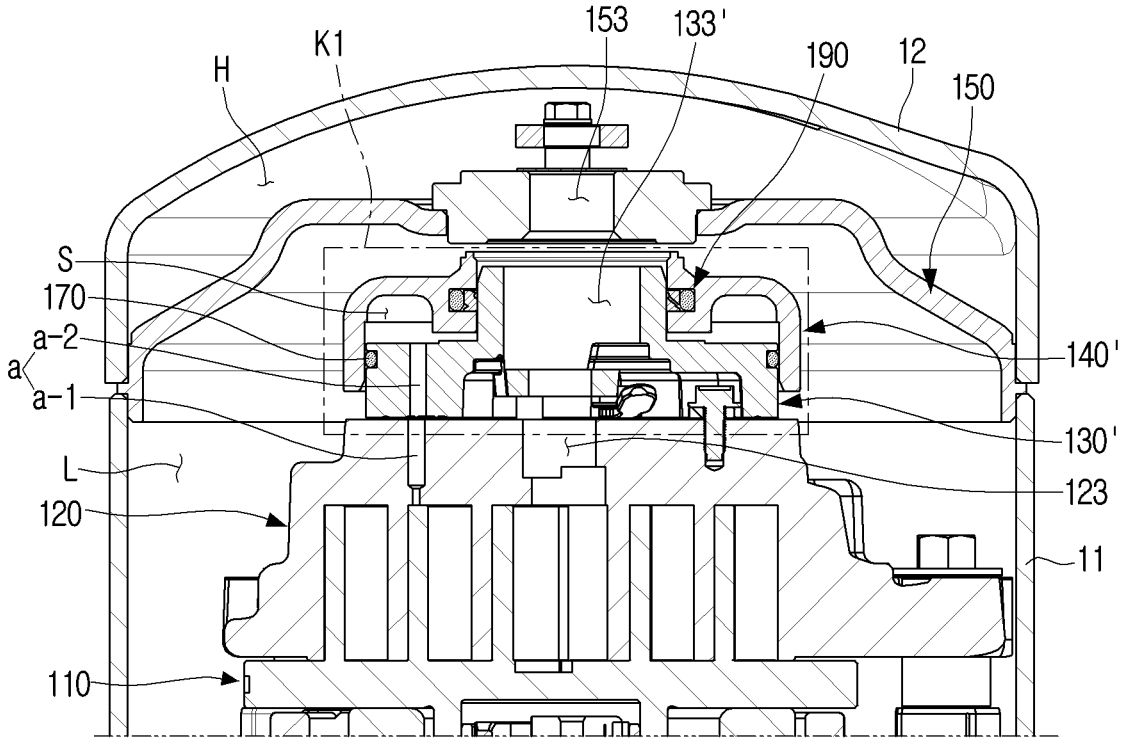
FIG. 35A is an enlarged view illustrating a first state according to driving of a scroll compressor according to an embodiment of the disclosure.
Figure 35B:
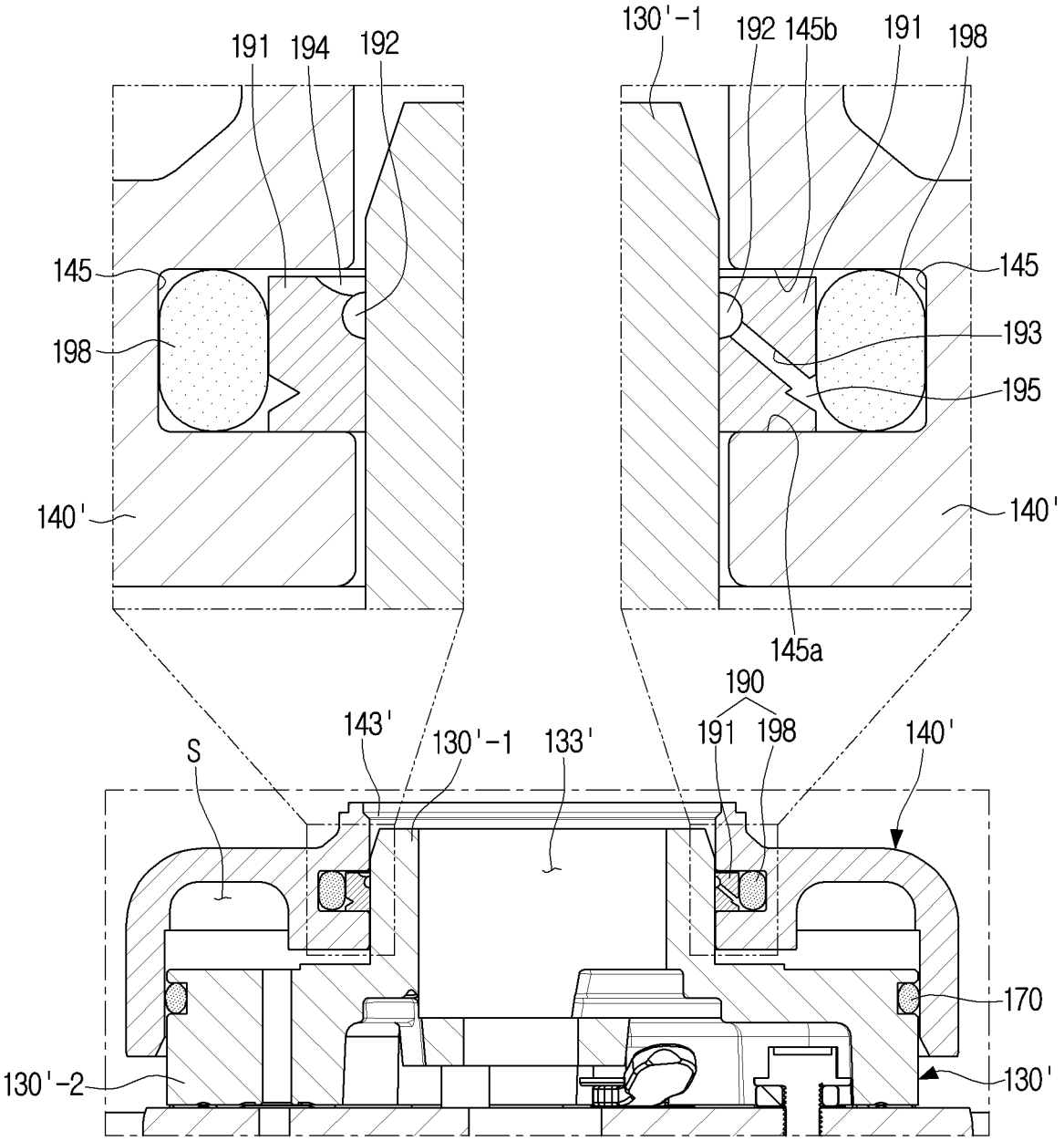
FIG. 35B is an enlarged view illustrating a region K1 of FIG. 35A.
Figure 36A:
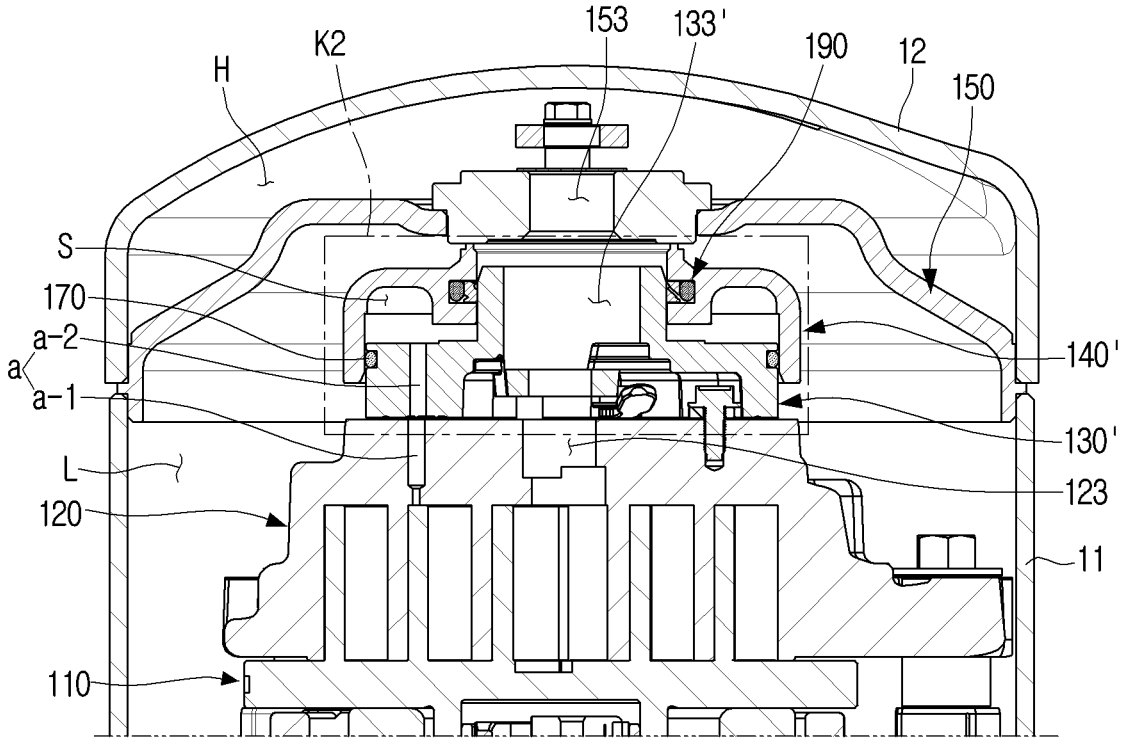
FIG. 36A is an enlarged view illustrating a second state according to driving of a scroll compressor according to an embodiment of the disclosure.
Figure 36B:
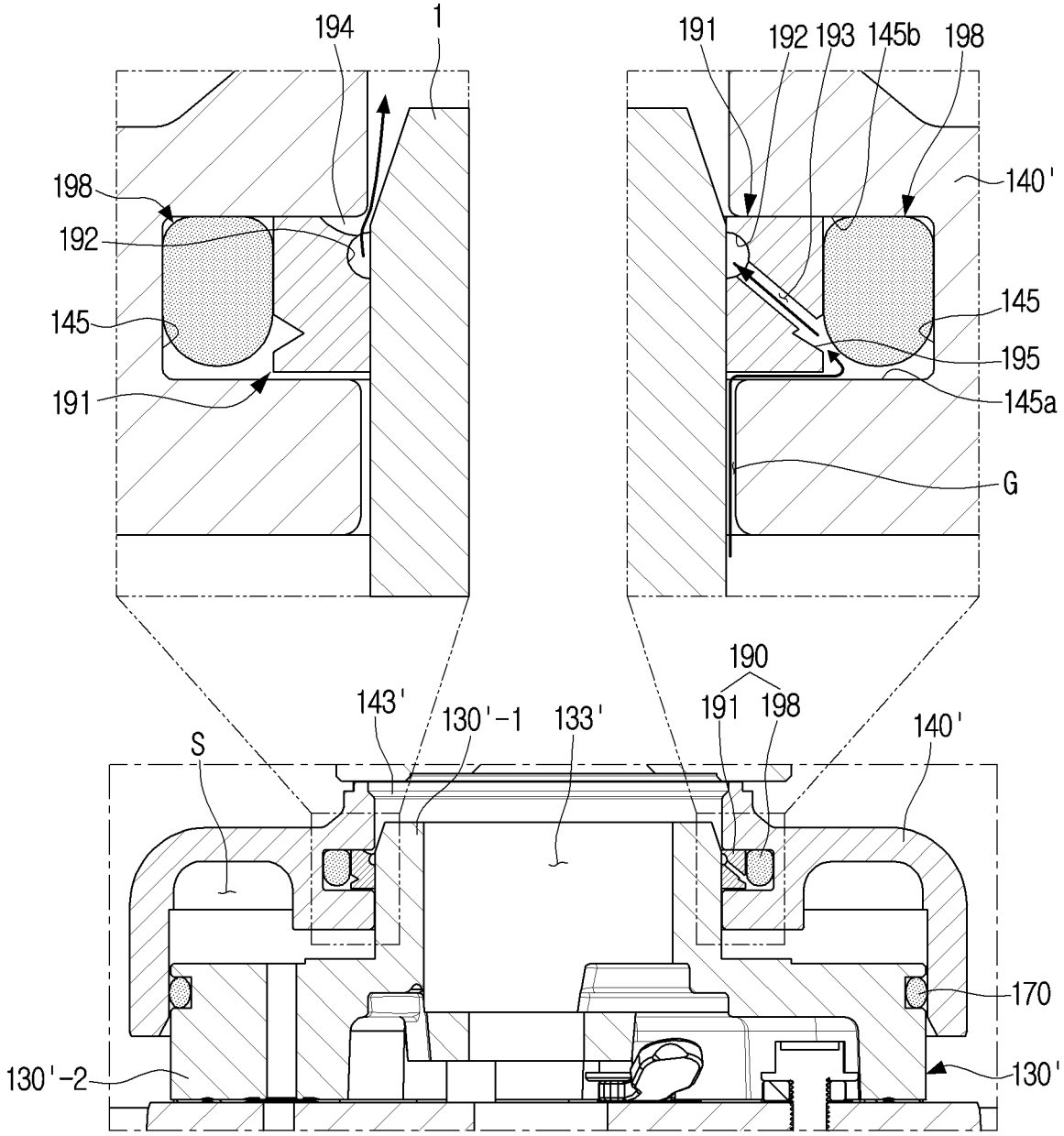
FIG. 36B is an enlarged view illustrating a region K2 of FIG. 36A.
Figure 37A:
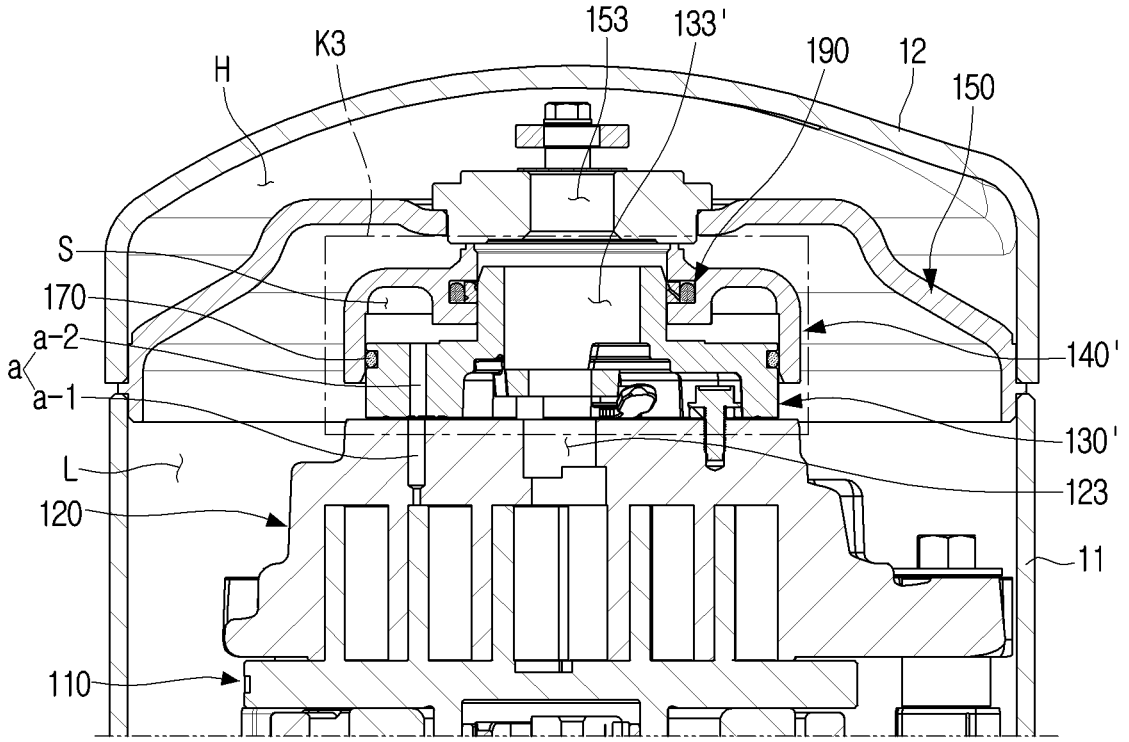
FIG. 37A is an enlarged view illustrating a third state according to driving of a scroll compressor according to an embodiment of the disclosure.
Figure 37B:
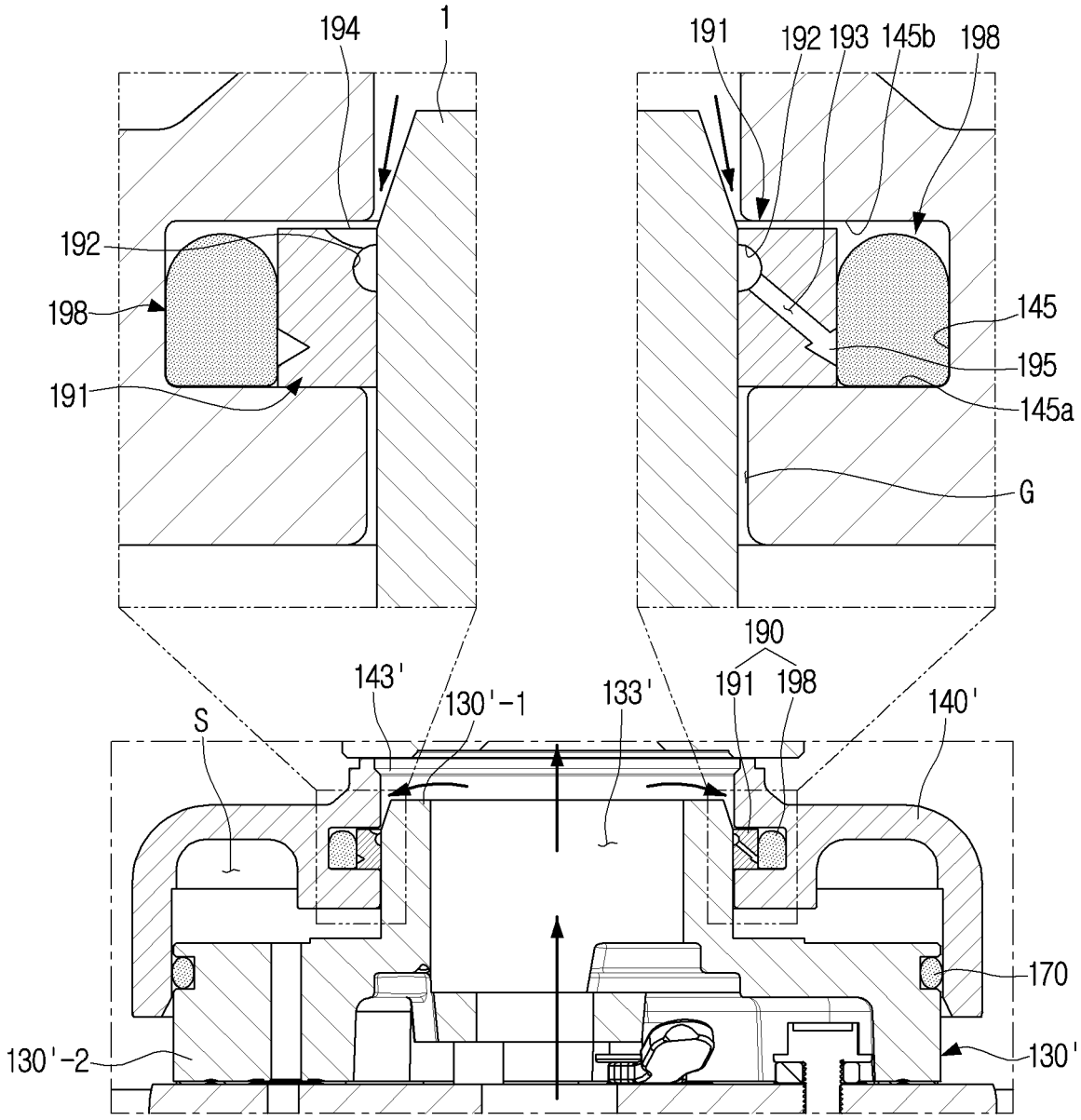
FIG. 37B is an enlarged view illustrating a region K3 of FIG. 37A.

FIG. 35A is an enlarged view illustrating a first state according to driving of a scroll compressor 1' according to an embodiment of the disclosure. FIG. 35B is an enlarged view illustrating a region K1 of FIG. 35A. FIG. 36A is an enlarged view illustrating a second state according to driving of a scroll compressor 1' according to an embodiment of the disclosure. FIG. 36B is an enlarged view illustrating a region K2 of FIG. 36A. FIG. 37A is an enlarged view illustrating a third state according to driving of a scroll compressor 1' according to an embodiment of the disclosure when it is driven. FIG. 37B is an enlarged view illustrating a region K3 of FIG. 37A.

Here, the first state refers to a state before the scroll compressor 1' is operated, the second state refers to a state in which the sealing member 190 is raised after scroll compressor 1' is operated so that the gap G is open, and the third state refers to a state in which the scroll compressor 1 continues to operate and the back pressure actuator 140' contacts the high and low pressure cover 150.

First, as illustrated in FIGS. 35A and 35B, in the first state, that is, when the scroll compressor 1' is in a stopped state, the sealing member 190 is position in the lower portion of the sealing accommodating groove 145. In detail, the lower surface of the sealing member 190, that is, the lower surface of the Teflon seal 191 is in contact with the lower surface 145*a* of the sealing accommodating groove 145, so that there is no gap between the lower surface 145*a* of the sealing accommodating groove 145 and the lower surface of the Teflon seal 191.

When the scroll compressor 1' operates in the first state, the orbiting scroll 110 may orbit and rotate relative to the fixed scroll 120.

Thus, the refrigerant is compressed by the compression chamber P formed by the orbiting scroll 110 and the fixed scroll 120 to increase the pressure, and the compressed refrigerant moves to the back pressure chamber S through the back pressure flow path a.

At this time, the compressed refrigerant in the compression chamber P does not exceed the selected pressure of the first check valve 136 and the bypass valves 124, and thus cannot move to the second discharge port 133'.

However, if necessary, by adjusting the selected pressure of the first check valve 136 and the bypass valves 124, the compressed refrigerant in the compression chamber P may flow to the low pressure section L.

The refrigerant moved to the back pressure chamber S presses the lower surface of the sealing member 190, that is, the lower surface of the Teflon seal 191 through the gap G formed between the first portion 130'-1 of the discharge guide 130' and the back pressure actuator 140'.

Thus, as illustrated in FIG. 36B, the sealing member 190 is raised, so that the upper surface of the sealing member 190, that is, the upper surface of the Teflon seal 191 is in contact with the upper surface 145*b* of the sealing accommodating groove 145, and the lower surface of the Teflon seal 191 is spaced apart from the lower surface 145*a* of the sealing accommodating groove 145 so that a gap is formed therebetween.

As a result, the refrigerant in the back pressure chamber S is introduced into the sealing accommodating groove 145 through the gap between the lower surface of the Teflon seal 191 and the lower surface 145*a* of the sealing accommodating groove 145. As illustrated in FIG. 36B, the refrigerant flowing into the sealing accommodating groove 145 is introduced into the refrigerant groove 192 through the inlet groove 195 and the connecting hole 193 of the Teflon seal 191.

The refrigerant flowing into the refrigerant groove 192 may be discharged to the outside of the sealing member 190 through the outlet 194. The refrigerant discharged to the outside of the sealing member 190 may be introduced into the second discharge port 133' through the gap between the fourth discharge port 143' of the back pressure actuator 140' and the first portion 130'-1 of the discharge guide 130'.

For example, when the first pressure in the back pressure chamber S is greater than the second pressure in the second discharge port 133', the sealing member 190 contacts the upper surface 145*b* of the sealing accommodating groove 145 and the refrigerant may move through the refrigerant passage of the sealing member 190.

In other words, the refrigerant in the back pressure chamber S may move to the second discharge port 133' due to the difference between the first pressure and the second pressure.

In detail, as illustrated in FIG. 36B, through the refrigerant passage of the sealing member 190 and the gap G between the discharge guide 130' and the back pressure actuator 140', the refrigerant in the back pressure chamber S may be discharged out of the back pressure chamber S along the discharge passage Y'.

Here, the second pressure in the second discharge port 133' may be the same as the pressure in the low pressure section L. On the other hand, the refrigerant in the back pressure chamber S may move only through the gap G spaced apart by the sealing member 190, and may not move between the extension portion 140'-2 of the back pressure actuator 140' and the second portion 130'-2 of the discharge guide 130' due to the O-ring member.

Accordingly, during the initial start-up of the scroll compressor 1', the refrigerant in the back pressure chamber S may pass through the sealing member 190 and move to the low pressure section L, so that the scroll compressor 1' operates without being affected by the initial pressure resistance.

In other words, the initial operating torque for filling the inside of the low pressure section L of the scroll compressor 1' with the selected pressure may be reduced.

In detail, considering that when the refrigerant in the back pressure chamber S cannot flow into the low pressure section L during the initial start-up of a scroll compressor, such as a scroll compressor according to the prior art, due to the pressure resistance caused by the compressed refrigerant in the compression chamber P and the back pressure chamber S, a lot of torque is required during the initial operation of the scroll compressor, the scroll compressor 1' according to an embodiment of the disclosure may reduce the initial operating torque through the sealing member 190 configured to selectively discharge the refrigerant in the back pressure chamber S to the low pressure section L.

As the scroll compressor 1 continuously operates, the pressure of the refrigerant in the back pressure chamber S increases, and due to the pressure of the refrigerant in the back pressure chamber S, the back pressure actuator 140' is moved upward relative to the discharge guide 130'.

Accordingly, the back pressure actuator 140' is in contact with and connected to the high and low pressure cover 150. In detail, the fourth discharge port 143' of the back pressure actuator 140' is connected to the third discharge port 153 of the high and low pressure cover 150.

At this time, the pressure of the compressed refrigerant in the compression chamber P exceeds the selected pressure of the first check valve 136 and the second check valve 154, so the first check valve 136 and the second check valve 154 are open.

Therefore, the low pressure section L and the high pressure section H in the main body 10 are separated, and the refrigerant compressed in the compression chamber P moves to the high pressure section H through the second discharge port 133', the fourth discharge port 143', and the third discharge port 153, and then moves to the outside of the main body 10.

On the other hand, some of the refrigerant discharged to the second discharge port 133' is introduced into the gap between the inner surface of the fourth discharge port 143' of the back pressure actuator 140' and the outer circumferential surface of the first portion 130-1 of the discharge guide 130', thereby pressing the sealing member 190 in the downward direction.

At this time, because the first pressure in the back pressure chamber S is lower than the second pressure in the second discharge port 133', the sealing member 190 is moved downward as illustrated in FIG. 37A. Thus, as illustrated in FIG. 37B, the lower surface of the Teflon seal 191 of the sealing member 190 is in contact with the lower surface 145*a* of the sealing accommodating groove 145, and the O-ring 198 is also pressed by the refrigerant to close the inlet groove 195 of the Teflon seal 191. Therefore, the refrigerant discharged to the second discharge port 133' is not introduced into the back pressure chamber S through the sealing member 190.

On the other hand, because the discharge guide 130' and the back pressure actuator 140' are separated from each other by the sealing member 190 and the O-ring member 170, when the back pressure actuator 140' moves, the noise generated by contact with the discharge guide 130' may be reduced.

Therefore, the scroll compressor 1' according to an embodiment of the disclosure may improve the compression efficiency and greatly reduce the noise generated during operation of the scroll compressor 1'.

In addition, in the scroll compressor 1' according to an embodiment of the disclosure, when an abnormal state in which the pressure in back pressure chamber S is higher than the discharge pressure occurs during operation, the high pressure refrigerant in the back pressure chamber S may be automatically discharged to the second discharge port 133' through the refrigerant passage of the sealing member 190 (see FIG. 36B).

In the above, although various embodiments of the disclosure have been individually described, each embodiment is not necessarily implemented alone, and the configuration and operation of each embodiment may be implemented in combination with at least one other embodiment.

In addition, although the preferred embodiments of the disclosure have been shown and described above, the disclosure is not limited to the specific embodiments described above, and it would be appreciated by those skilled in the art that changes may be made in this embodiment without departing from the principles and sprit of the disclosure, the scope of which is defined in the claims and their equivalents. In addition, these modifications should not be individually understood from the technical idea or prospect of the disclosure.

What is claimed is:

1. A scroll compressor comprising:

a main body;

a cover configured to divide an inside of the main body into a low pressure section and a high pressure section;

a fixed scroll disposed in the low pressure section and including a first discharge port;

an orbiting scroll configured to rotate with respect to the fixed scroll;

a compression chamber formed by the fixed scroll and the orbiting scroll to compress refrigerant therein;

a discharge guide disposed between the fixed scroll and the cover, the discharge guide including a second discharge port and selectively communicating the second discharge port with the first discharge port to discharge the compressed refrigerant in the compression chamber to the cover;

a back pressure actuator disposed to surround an outer circumferential surface of the discharge guide to form a back pressure chamber together with the discharge guide and configured to move in a direction toward the cover with respect to the discharge guide to selectively connect the second discharge port with the high pressure section; and a sealer disposed between the back pressure actuator and the discharge guide, and configured to selectively open or close a gap between the back pressure actuator and the discharge guide, the sealer including a seal having a refrigerant flow path and an O-ring coupled to an outer circumferential surface of the seal to selectively open or close the refrigerant flow path.

2. The scroll compressor as claimed in claim 1, wherein the fixed scroll comprises a first back pressure flow path spaced apart from the first discharge port and connected to the compression chamber, and wherein the discharge guide comprises a second back pressure flow path spaced apart from the second discharge port and connecting the first back pressure flow path to the back pressure chamber.

3. The scroll compressor as claimed in claim 1, wherein the cover includes a third discharge port, and wherein when the scroll compressor is operated, the back pressure actuator is moved by the refrigerant in the back pressure chamber to communicate the third discharge port of the cover with the second discharge port of the discharge guide, and when the scroll compressor is not operated, the back pressure actuator is spaced apart from the cover.

4. The scroll compressor as claimed in claim 3, further comprising:

a first check valve disposed at the second discharge port of the discharge guide to selectively open or close the first discharge port; and a second check valve disposed at the third discharge port of the cover to selectively open or close the third discharge port.

5. The scroll compressor as claimed in claim 1, wherein the refrigerant flow path comprises:

a refrigerant groove formed on an inner circumferential surface of the seal;

an outlet formed on an upper surface of the seal and in fluid communication with the refrigerant groove; and a connecting hole formed to communicate the outer circumferential surface of the seal with the refrigerant groove.

6. The scroll compressor as claimed in claim 5, wherein the refrigerant flow path further comprises an inlet groove formed on the outer circumferential surface of the seal and connected to the connecting hole.

7. The scroll compressor as claimed in claim 1, wherein the discharge guide comprises:

a first part forming the second discharge port; and a second part connected to the first part and having a diameter greater than a diameter of the first part, and wherein the back pressure actuator includes a fourth discharge port into which the first part of the discharge guide is inserted and a sealing accommodating groove which is formed on an inner surface of the fourth discharge port and in which the sealer is disposed.

8. The scroll compressor as claimed in claim 7, wherein the sealer is movable up and down in the sealing accommodating groove, and wherein an outer circumferential surface of the first part of the discharge guide is in contact with an inner surface of the sealer, and is spaced apart from the inner surface of the fourth discharge port of the back pressure actuator.

9. The scroll compressor as claimed in claim 1, wherein the fixed scroll comprises: a bypass flow path formed in the fixed scroll and connecting the compression chamber to the second discharge port; and a bypass valve configured to selectively open or close the bypass flow path.

10. The scroll compressor as claimed in claim 9, wherein the bypass flow path and the bypass valve are provided with a plurality of bypass flow paths and a plurality of bypass valves, respectively.

* * * * *